US011328838B2

(12) United States Patent
Liu et al.

(10) Patent No.: US 11,328,838 B2
(45) Date of Patent: May 10, 2022

(54) COLOR-CODED CABLE IDENTIFICATION ASSEMBLY AND CABLE

(71) Applicant: CommScope Technologies LLC, Hickory, NC (US)

(72) Inventors: Jin Liu, Jiangsu (CN); Jianping Wu, Jiangsu (CN); Gangping Lei, Jiangsu (CN); Jien Zheng, Jiangsu (CN); Hongjuan An, Jiangsu (CN); Yujun Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/237,451

(22) Filed: Apr. 22, 2021

(65) Prior Publication Data

US 2021/0375504 A1 Dec. 2, 2021

(30) Foreign Application Priority Data

May 26, 2020 (CN) ..... 202010452773.9
May 26, 2020 (CN) ..... 202010452789.X
May 26, 2020 (CN) ..... 202010452791.7

(51) Int. Cl.
*H01B 7/00* (2006.01)
*H01B 7/36* (2006.01)

(52) U.S. Cl.
CPC ..... *H01B 7/361* (2013.01)

(58) Field of Classification Search
CPC ..... H01B 7/361
See application file for complete search history.

(56) References Cited

U.S. PATENT DOCUMENTS 5,529,513 A 6/1996 Lee
5,912,437 A * 6/1999 Mazaris ..... H02G 11/02 174/135

(Continued)

FOREIGN PATENT DOCUMENTS

KR 101347487 B1 1/2014

OTHER PUBLICATIONS

"International Search Report and Written Opinion corresponding to International Application No. PCT/US2021/029324 dated Aug. 13, 2021".

*Primary Examiner* — Pete T Lee
(74) *Attorney, Agent, or Firm* — Myers Bigel, P.A.

(57) ABSTRACT

The present disclosure relates to a color-coded cable identification assembly and a cable. The cable identification assembly comprises: a support element including a fixing element adapted to fix the support element to a cable; and a plurality of identification elements, which are detachably mounted on the support element with the cable being located between the support element and the plurality of identification elements. Each identification element has a predetermined color so that the plurality of identification elements are capable of forming a predetermined color code to identify the cable. The cable identification assembly according to the present disclosure can be very easily and rapidly mounted to the cable, thereby greatly saving the installation time of workers and thus reducing the labor cost and the chance of making a mistake. Compared with a conventional adhesive tape, the cable identification assembly according to the present disclosure can meet the requirements such as anti-ultraviolet, anti-aging and reuse, thereby further reducing the cost of the cable identification assembly.

14 Claims, 16 Drawing Sheets

(56) References Cited

U.S. PATENT DOCUMENTS

| | | | | |
|---|---|---|---|---|
| 9,022,327 | B2 * | 5/2015 | Wallingford | H05K 7/1491<br>248/68.1 |
| 2002/0092670 | A1 | 7/2002 | Fang et al. | |
| 2004/0072476 | A1 * | 4/2004 | Baier | H01R 12/616<br>439/874 |
| 2011/0244714 | A1 | 10/2011 | Feldmeier et al. | |
| 2017/0346231 | A1 | 11/2017 | De Dios Martin et al. | |

* cited by examiner

COLOR-CODED CABLE IDENTIFICATION ASSEMBLY AND CABLE

RELATED APPLICATIONS

The present application claims priority from and the benefit of Chinese Patent Application Nos. 202010452773.9, filed May 26, 2020; 202010452789.X, filed May 26, 2020, and 202010452791.7, filed May 26, 2020, the disclosures of which are hereby incorporated by reference herein in full.

TECHNICAL FIELD

The present disclosure generally relates to a communication system. More particularly, the present disclosure relates to a cable identification assembly for identifying various cables connected to a base station antenna, and a cable mounted with the cable identification assembly.

BACKGROUND ART

Cellular communication systems are used to provide wireless communications to fixed and mobile subscribers. A cellular communication system may include a plurality of base stations, each of which provides a wireless cellular service for a specific coverage area that is typically referred to as a "cell". Each base station may include one or more base station antennas for transmitting radio frequency ("RF") signals to and receiving RF signals from the subscribers that are within the cell served by the base station.

The base station antenna includes many ports for connecting cables (e.g. jumpers), each of which corresponds to a different sector and frequency band. In order to correctly connect a plurality of cables to corresponding ports of the base station antenna and facilitate subsequent operations (for example, maintenance or the like), there is a need to identify and distinguish each cable. Currently, one practice is to provide a different color code on each cable to identify which port of the base station antenna should be connected with each cable. For example, each cable may be provided with a color code containing five sections, wherein the first section may use a selected color to indicate a sector corresponding to this cable, the second section and the third section may use selected colors to indicate a frequency band corresponding to this cable, and the fourth section and the fifth section may use selected colors to indicate a port corresponding to this cable.

Currently, the color code provided on each cable is formed by winding different colors of tapes on this cable in a predetermined sequence. In this manner, there are defects and shortcomings. First, it is usually a long process to wind tapes on a cable so that a high labor cost may result. For example, in order to wind different colors of tapes for all cables of the base station antennas at a site, it generally consumes a whole day for one worker. In this way, if it is necessary to provide color codes for all cables of the base station antennas at 10,000 sites, the labor cost may be up to about 4.8 million US dollars. In addition, heavy work may also increase the possibility that the workers provide wrong color codes on the cables. Next, in a current operation, the tapes are usually wrapped around a cable after the cable has been connected to each port of the base station antenna for ensuring correct connection of the cable in a subsequent operation (for example, ensuring correct connection of the cable after repairing the cable). This results in the operation of winding tape being very difficult, since individual cables connected to the base station antenna are very close to one another. Finally, it is also found that the tapes currently used for providing color codes on the cables are easily affected by ultraviolet rays, operating temperatures, aging and the like, thereby significantly shortening the service life of the color codes provided on the cables.

SUMMARY

It is one of the objects of the present disclosure is to provide a cable identification assembly with color codes, which are capable of overcoming one or more problems present in the prior art.

In a first aspect of the invention, a color-coded cable identification comprises: a support element including a fixing element adapted to fix the support element to a cable; and a plurality of identification elements, which are detachably mounted on the support element with cable being located between the support element and the plurality of identification elements. Each identification element has a predetermined color, so that the plurality of identification elements are capable of forming a predetermined color code to identify the cable.

In a second aspect of the invention, a color-coded cable identification assembly comprises: a sleeve configured to be mounted over the cable with the cable extending through the sleeve; a plurality of identification rings, each of which includes at least one section provided with at least one predetermined color, so that the plurality of identification rings are capable of forming at least one color code; and a sheath configured to cooperate with the sleeve to retain the plurality of identification rings therebetween. The sheath has a viewing window, and when the cable identification assembly has been assembled, the color code formed by the plurality of identification rings is exposed in the viewing window to identify the cable.

In a third aspect of the invention, a color-coded cable identification assembly comprises: a support element; and a plurality of identification elements, wherein each of the plurality of identification elements is lockable with the support element to form the cable identification assembly, and the plurality of identification elements fixedly mount the cable identification assembly to a cable by locking the cable between the support element and the plurality of identification elements. Each identification element has a predetermined color so that the plurality of identification elements are capable of forming a predetermined color code to identify the cable.

It is to be noted that, various aspects of the present disclosure described with respect to one embodiment may be incorporated into other different embodiments, although not specifically described with respect to the other different embodiments. In other words, all embodiments and/or features of any embodiment may be combined in any manner and/or combination, as long as they are not contradictory to one another.

BRIEF DESCRIPTION OF THE DRAWINGS

After reading the embodiments hereinafter in conjunction with the accompanying drawings, a plurality of aspects of the present invention will be better understood. In the accompanying drawings:

FIGS. 17A and 17B show perspective views of an identification ring of the color-coded cable identification assembly according to the second embodiment of the present disclosure, wherein FIG. 17A shows the structure of a front side of the identification ring, and FIG. 17B shows the structure of a rear side of the identification ring;

FIGS. 22A and 22B show perspective views of a support element of the cable identification assembly shown in FIG. 21 from different angles of view, wherein FIG. 22A shows a front surface of the support element and FIG. 22B shows a back surface of the support element;

FIGS. 26A and 26B show perspective views of a support element cooperating with the cover shown in FIG. 25A from different angles of view, wherein FIG. 26A shows a front surface of the support element and FIG. 26B shows a back surface of the support element;

FIGS. 28A and 28B show perspective views of a support element cooperating with the cover shown in FIG. 27 from different angles of view, wherein FIG. 28A shows a front surface of the support element and FIG. 28B shows a back surface of the support element;

It should be understood that, in all the accompanying drawings, the same reference signs present the same elements. In the drawings, for the sake of clarity, the sizes of certain features may be altered rather than being delineated to scale.

EMBODIMENTS

Figure 1A:
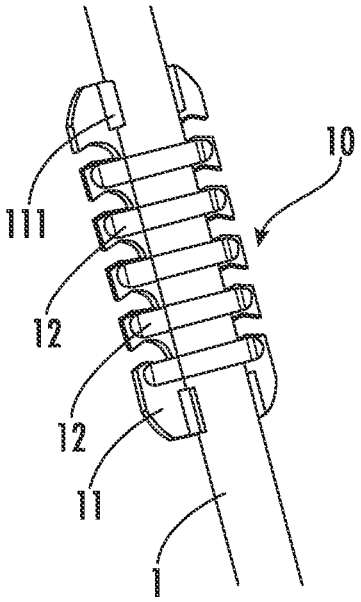
FIGS. 1A and 1B show perspective views of one embodiment of a color-coded cable identification assembly according to the disclosure from different angles of view.

The present disclosure will be described below with reference to the accompanying drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any longer.

The singular forms "a/an", "said" and "the" as used in the specification, unless clearly indicated, all contain the plural forms. The wordings "comprising", "containing" and "including" used in the specification indicate the presence of the claimed features, but do not repel the presence of one or more other features. The wording "and/or" as used in the specification includes any and all combinations of one or more of the relevant items listed.

The phases "between X and Y" and "between about X and Y" as used in the specification should be construed as including X and Y. The phrase "between about X and Y" as used in the present specification means "between about X and about Y", and the phrase "from about X to Y" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element.

In the specification, the terms "first", "second", "third" and "fourth" are used for convenient description only but not intended to be restrictive. Any technical features represented by "first", "second", "third" and "fourth" are interchangeable.

In the specification, the spatial relation wordings such as "up", "down", "forth", "back", "top", "bottom" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations). At this time, the relative spatial relations will be explained correspondingly.

The present disclosure proposes a color-coded cable identification assembly that can be used to identify: cables connected in different ports of an electrical or electronic equipment. The electric or electronic device may be a communication device, such as a base station antenna; and the cable may be an electrical cable (such as a jumper), an optical cable, or the like.

Figure 1B:
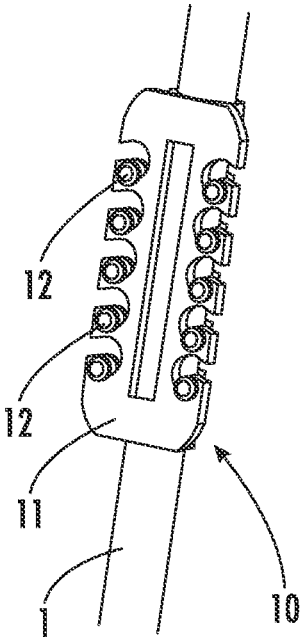

Referring to FIGS. 1A and 1B, a color-coded cable identification assembly 10 according to one embodiment of the present disclosure is shown. The cable identification assembly 10 may include: a support element 11 including a fixing element 111 adapted to fix the support element to a cable 1; and a plurality of identification elements 12, which may be detachably mounted on the support element 11 with the cable 1 located between the support element 11 and the plurality of identification elements 12, Each identification element 12 may have a predetermined color, such that the plurality of identification elements may form at least one color code such as in a predetermined color array, so as to identify the cable.

Figure 2:
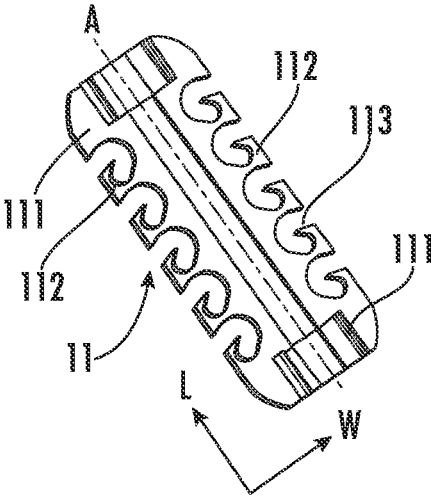
FIG. 2 shows a perspective view of one embodiment of a support element of the cable identification assembly shown in FIGS. 1A and 1B.
Figure 3:
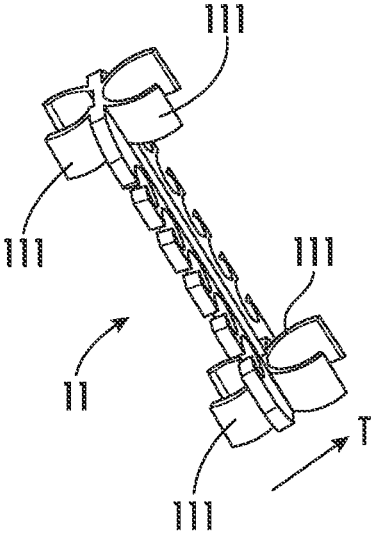
FIG. 3 shows a perspective view of another embodiment of a support element of the cable identification assembly shown in FIGS. 1A and 1B.

Referring to FIGS. 2 and 3, the specific structure of one embodiment of the support element 11 of the cable identification assembly 10 according to the present disclosure is shown. As shown in FIGS. 2 and 3, the support element 11 may have a plate shape. The support member 11 may have a length direction L, a width direction W, and a thickness direction T, and may have a center line A extending along the length direction L. As described above, the support element 11 is provided with a fixing element 111 adapted to fix the support element 11 to the cable 1. The fixing element 111 may be configured to extend outward from the surface of the support element along the thickness direction T thereof. In the embodiments shown in FIGS. 2 and 3, the fixing element 111 is constructed as a C-shaped claw. The C-shaped claw may be an elastic C-shaped claw, so that the cable 1 can be pressed into the C-shaped claw via the opening of the latter and the cable 1 is held in the C-shaped claw by the elastic force of the latter, thereby fixing the support element 11 on the cable 1.

In the embodiment shown in FIG. 2, the support element is provided with a pair of fixing elements 111, which are located on the same surface of the support element and located at two opposite ends of the support element along the length direction L thereof. However, the present disclosure is not limited to this, and the support element may be provided with other numbers of the fixing elements 111, such as one or three fixing elements. When the support element 11 is provided with one fixing element 111, the fixing element may be located at an intermediate position of the support element along the length direction L. When the support element 11 is provided with three fixing elements 111, the fixing elements may be located at two opposite ends as well as the intermediate position of the support element along the length direction L thereof respectively.

In the embodiment shown in FIG. 3, the support element 11 is provided with two pairs of fixing elements 111, which are located on the front and back sides of the support element 11 respectively. One pair of fixing elements 111 disposed on the front side of the support element 11 and one pair of fixing elements 111 disposed on the back side of the support element 11 may have different sizes to accommodate cables in different sizes. In other words, when a cable has a small size, a pair of fixing elements of the support element 11 which have a smaller size may be used; and when a cable has a large size, a pair of fixing elements of the support element 11 which have a larger size may be used. Each of the front and back sides of the support element 11 may also be provided with other numbers of fixing elements, such as one or three fixing elements. When each of the front and back sides of the support element 11 is provided with one fixing element 111, the fixing element on each side may be located in the intermediate position of the support element along the length direction L. When each of the front and back sides of the support element 11 is provided with three fixing elements 111, the three fixing elements on each side may be located at two opposite ends and the intermediate position of the support element along the length direction L thereof. In addition, the number of the support elements provided on the front side of the support element 11 and the number of support elements provided on the rear side of the support element 11 may not be equal.

In embodiments according to the present disclosure, the support element 11 and the fixing element 111 may be integrally formed. However, the present disclosure is not limited thereto. The support element 11 and the fixing element 111 may be separately formed, and then connected together by appropriate means (e.g. welding, snap-fit connection, and the like).

With continued reference to FIGS. 2 and 3, the support element 11 may include a plurality of pairs of mounting portions 112 for mounting the plurality of identification elements 12, and each pair of mounting portions are adapted to mount one identification element 12. In the embodiment shown in FIG. 2, the plurality of pairs of mounting portions are arranged along the length direction L of the support element 11, and two mounting portions in each pair of mounting portions are located on two sides of the support element 11 in a symmetrical manner relative to a center line A of the support element 11 along the width direction W thereof. Each mounting portion may include a guide groove 113 having a curved path so that one end of the identification element 12 may slide into the mounting portion 112 along the curved path of the guide groove 113 and be held in the mounting portion 112. The curved path of the guide groove 113 may be substantially helical, thereby helping to hold the end of the identification element 12 in the mounting portion. The guide groove 113 may penetrate through the entire thickness of the support element 11 as shown in FIG. 2, However, the present disclosure is not limited thereto. The guide groove 113 may extend through only a part of the thickness of the support element 11, thereby forming a guide recess having a curved path. The end of the identification element 12 can slide into the mounting portion 112 along the curved path of the guide recess and be held in the mounting portion 112.

In embodiments according to the present disclosure, the support element 11 may be made from plastic. For example, the support element 11 may be made by molding using a plastic material. However, the present disclosure is not limited thereto. The support element 11 may be made from other materials (for example, light metal materials such as aluminum). For example, the support element 11 may be Made by machining using light metal materials.

Figure 4:
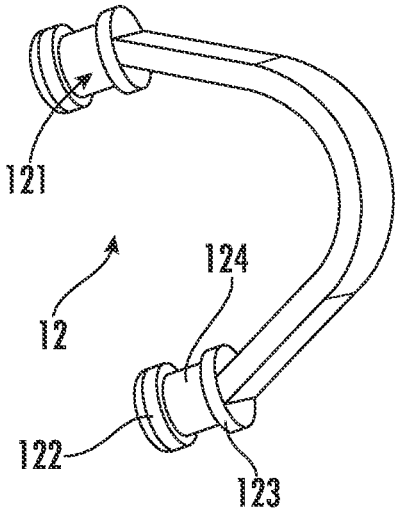
FIG. 4 shows a perspective view of one embodiment of an identification ring of the cable identification assembly shown in FIGS. 1A and 1B.

Referring to FIG. 4, a specific structure of one embodiment of the identification element 12 of the cable identification assembly 10 according to the present disclosure is shown. The identification element 12 may be constructed as a substantially C-shaped flexible strip. The end of the identification element 12 may include a cylindrical portion 121. The cylindrical portion 121 may include a first step 122 and a second step 123 spaced apart as well as a recess 124 formed between the first step 122 and the second step 123. When the identification elements 12 are mounted in the mounting portion 112 of the support element 11, the depression 124 of the identification element 12 is located in the guide groove, and the first step 122 and the second step 123 are located on the upper side and the lower side of the guide groove respectively, thereby restricting the movement of the identification element 12 in the thickness direction of the support element 11.

As described above, each identification element 12 may have a predetermined color, such as any one of white, red, blue, green, black, yellow, orange, brown, violet, slate, or other colors. To this end, each identification element 12 may be made from a material (for example plastics such as PC material, POM material and PA material) having a predetermined color. This not only allows each identification element 12 to have a predetermined color, but also enables each identification element 12 to meet the requirements such as anti-ultraviolet, anti-aging and reuse.

When a cable is identified using the cable identification assembly 10 according to the present disclosure, first, the cable 1 is pressed into the fixing element 111 of the support element 11 to mount the support element 11 to the cable 1, which facilitates the subsequent installation of the identification elements 12; then, according to a predetermined color code, an identification element 12 having a predetermined color is selected, both ends of the identification element 12 selected are placed into the guide grooves of a corresponding pair of mounting portions 112 of the support element 11 from one side facing the fixing element 111 of the support element 11, and both ends of the identification element 12 selected are slid into and held in the corresponding pair of mounting portions 112 of the support element 11 along the curved path of the guide grooves; this step is repeated until all identification elements 12 are selected and mounted to the support element 11. In this way, the plurality of identification elements 12 selected form the predetermined color code in a color array, so as to identify the cable.

The cable identification assembly 10 according to the present disclosure can be easily and rapidly mounted to the cable 1, so that it is possible to greatly save the installation time of workers and thus reduce the labor cost and the chance of making a mistake. In addition, since each identification element 12 can be detachably mounted on the support element 11, the cable identification assembly 10 according to the present disclosure also allows one or more of the plurality of identification elements 12 to be quickly removed from the assembled cable identification assembly 10 and allows reselected identification elements 12 with other predetermined colors to be quickly assembled. Therefore, the cable identification assembly 10 according to the present disclosure can realize the rapid adjustment of the color code, which is particularly advantageous when the color code of the cable identification assembly 10 needs to be adjusted (for example, some cables are needed to have different color codes in the test phase and normal working phase of the base station antenna). Furthermore, compared with a conventional adhesive tape, various components of the cable identification assembly 10 according to the present disclosure may be made from plastic, metal, or other materials respectively, so that it is possible to meet the requirements such as anti-ultraviolet, anti-aging and reuse, which may further reduce the cost of the cable identification assembly 10.

Figure 5:
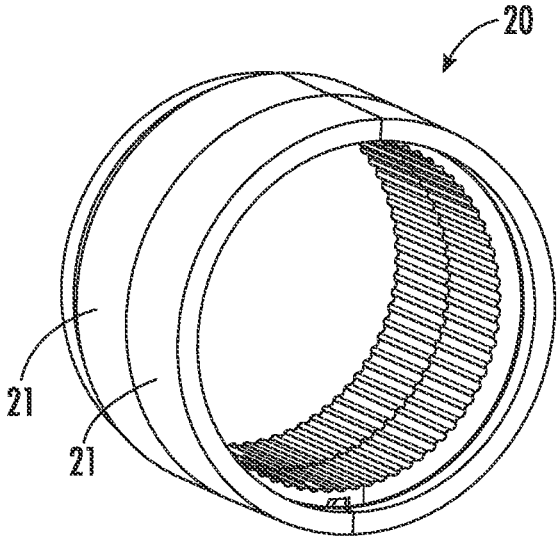
FIG. 5 shows a perspective view of another embodiment of the cable identification assembly according to the present disclosure.

Referring to FIG. 5, a color-coded cable identification assembly 20 according to another embodiment of the present disclosure is shown. The cable identification assembly 20 includes a plurality of identification elements 21 that can be connected to each other. Each identification element 21 has a predetermined color so that the plurality of identification elements 21 may form a predetermined color code such as in a predetermined color array, so as to identify the cable.

Figure 6:
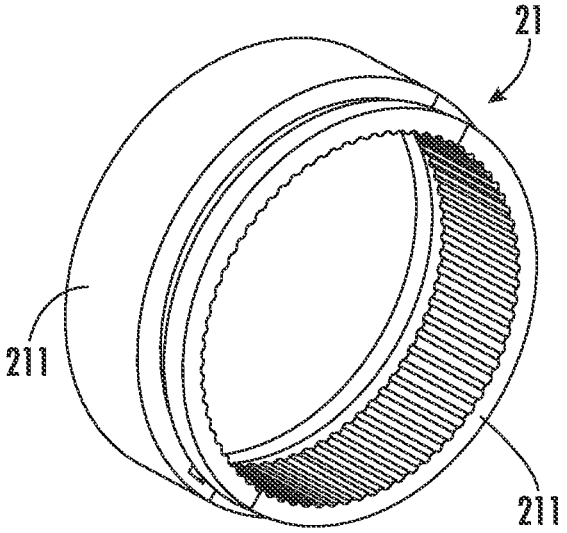
FIG. 6 shows a perspective view of one embodiment of an identification element of the cable identification assembly shown in FIG. 5.
Figure 7:
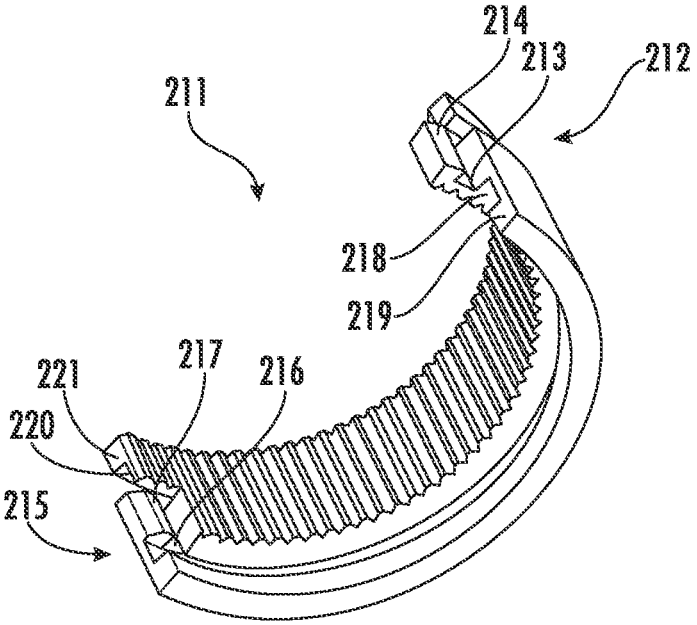
FIG. 7 shows a perspective view of one embodiment of a half body of the identification element shown in FIG. 6.
Figure 8:
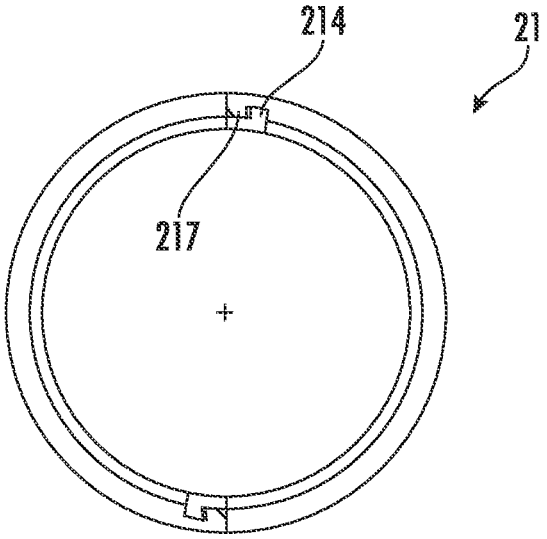
FIG. 8 shows a schematic view of two half bodies shown in FIG. 7 in a snap-fit connection to form one identification element.

Referring to FIG. 6, the specific structure of the identification element 21 is shown, Each identification element 21 may include two half bodies 211 that fix each identification element 21 on the cable 1 by surrounding the cable 1 between the two half bodies. The two half bodies 211 of each identification element 21 may have the same structure and can be connected to each other, FIG. 7 shows the specific structure of a half body 211. As shown in FIG. 7, the half body 211 may have a semicircular shape. The first end 212 of each half body 211 may have a first groove 213 opened outward and a first snap-fit element 214 protruding outward. The second end 215 of each half body 211 may have a second groove 216 opened inward and a second snap-fit element 217 protruding inward. The first groove 213 and the first snap-fit element 214 as well as the second groove 216 and the second snap-fit element 217 may all extend along the axial direction of each half body 211. The first groove 213 of the first end 212 of one half body 211 can receive the second snap-fit element 217 of the second end 215 of another half body 211, and the second groove 216 of the second end 215 of the one half body 211 can receive the first snap-fit element 214 of the first end 212 of said another half body 211, so that the two half bodies 211 can form one identification element 21 by snap-fitted to each other. FIG. 8 shows a schematic view of the two half bodies 211 in a snap-lit connection to form the identification element 21. It may also be clearly seen from FIG. 8 that the first snap-fit element 214 and the second snap-fit element 217 of the half body 211 may have inclined inner surfaces. In this way, when the first snap-fit element 214 and the second snap-fit element 217 of the one half body 211 are snap-fit together with the second snap-fit member 217 and the first snap-fit member 214 of said another half body 211, the two half bodies 211 can be firmly connected so that it is not likely to disengage them from each other.

Figure 9:
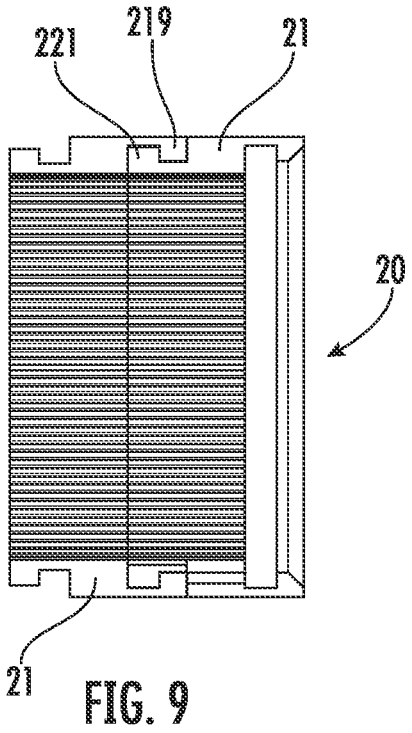
FIG. 9 shows a schematic view of two identification elements shown in FIG. 6 in a snap-fit connection to form one cable identification assembly.

The inner surface of each half body 211 may have a third groove 218 opened inward and a third snap-fit element 219 protruding inward. The outer surface of each half body 211 may have a fourth groove 220 opened outward and a fourth snap-fit element 221 protruding outward. The third groove 218 and the third snap-fit element 219 as well as the fourth groove 220 and the fourth snap-fit element 221 may all extend along the circumferential direction of each half body 211, and the third groove 218 and the third snap-fit element 219 are spaced apart from the fourth groove 220 and the fourth snap-fit element 221 in the axial direction of each half body 211. When the cable identification assembly 20 is formed, the third groove 218 of the half body 211 of one identification element 21 can receive the fourth snap-fit element 221 of the half body 211 of another identification element 21, and the fourth groove 220 of the half body 211 of the one identification element 21 can receive the third snap-fit element 219 of the half body 211 of said another identification element 21, so that the two identification elements 21 may be snap-fitted with each other. FIG. 9 shows a schematic view of the third snap-fit element 219 of one identification element 21 and the fourth snap-fit element 221 of another identification element 21 that are snap-fitted together to form the cable identification assembly 21.

In order to firmly fix the cable identification assembly 20 to the cable, the inner surface of each half body 211 of the identification element 21 may include serrated portions (as shown in FIGS. 5 to 7), which can increase a contact force or friction force between each half body 211 and the cable, so that it is possible to effectively prevent the formed cable identification assembly 20 from sliding on the cable, thereby firmly fixing the cable identification assembly 20 to the cable. However, the present disclosure is not limited thereto. The inner surface of each half body 211 of the identification element 21 may include dot-like protrusions, crossed strip-like protrusions, or any other suitable configurations. The inner surface of each half body 211 of the identification element 21 may also include a plurality of ribs distributed along the circumferential direction of each half body 211 and extending along the axial direction thereof.

Similarly, in this embodiment, each identification element 21 may have a predetermined color, such as any one of white, red, blue, green, black, yellow, orange, brown, violet, slate, or other colors. To this end, each identification element 21 may be made from a material (for example plastics such as PC material, POM material and PA material) having a predetermined color. This not only allows each identification element 21 to have a predetermined color, but also enables that each identification element 21 meets the requirements such as anti-ultraviolet, anti-aging or reuse.

In this embodiment, the cable identification assembly 20 comprises a plurality of half bodies having the same structure, which makes it relatively easy to manufacture the cable identification assembly 20, since there is no need to manufacture various members of different structures. Similarly, the cable identification assembly 20 can be very easily and rapidly mounted to the cable, thereby greatly saving the installation time of workers and thus reducing the labor cost and the chance of making a mistake.

In the embodiments shown in the accompanying drawings, the cable identification assembly 10 is shown to include five identification elements 12, and the cable identification assembly 20 is shown to include two identification elements 21. However, the present disclosure is not limited thereto. The cable identification assemblies 10 and 20 may include any other number of identification elements (e.g. two, three, four, six, seven, eight, etc.), thereby forming various different color codes to identify the cable.

Figure 10:
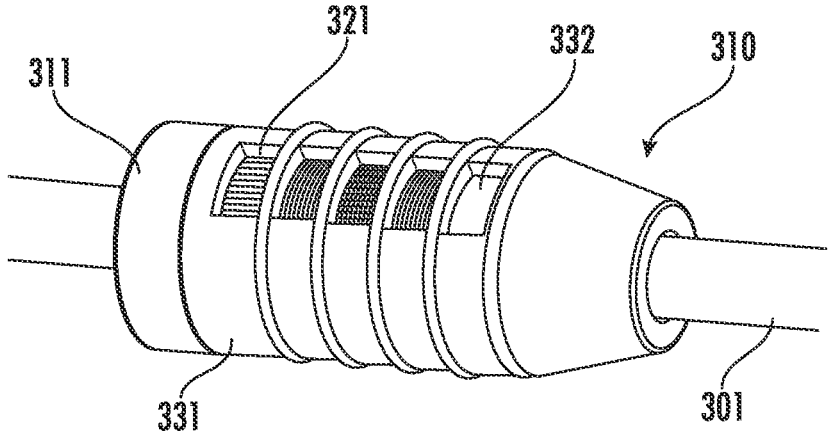
FIG. 10 shows a perspective view of a color-coded cable identification assembly according to embodiments of the present disclosure.

Referring to FIG. 10, a perspective view of a color-coded cable identification assembly 310 according to the present disclosure is shown. The cable identification assembly 310 may include a sleeve 311 configured to be mounted over a cable 301 with the cable 301 extending through the sleeve 311; a plurality of identification rings 321, each of which includes at least one section provided with at least one predetermined color so that the plurality of identification rings may form at least one color code such as in a predetermined color array; and a sheath 331 configured to cooperate with the sleeve 311 to clamp the plurality of identification rings 321 therebetween. The sheath 331 has a viewing window 332. Once the cable identification assembly 310 has been assembled, the color code formed by the plurality of identification rings can be exposed in the viewing window 332 to identify the cable 301.

Figure 11:
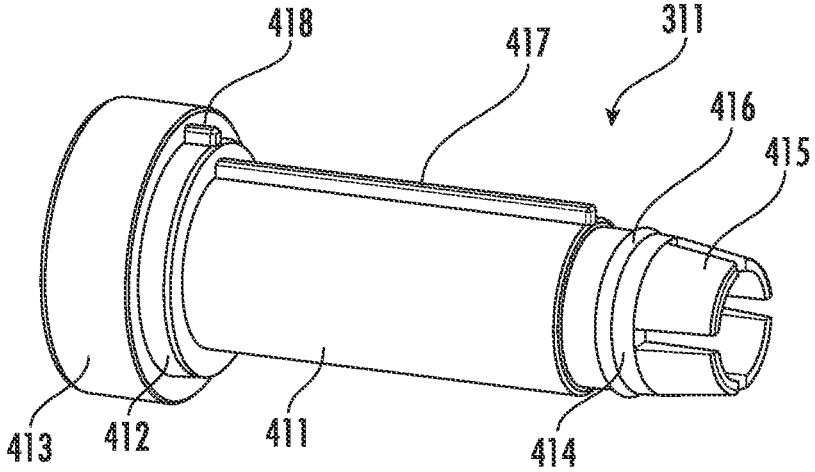
FIG. 11 shows a perspective view of a sleeve of the color-coded cable identification assembly according to a first embodiment of the present disclosure.
Figure 12:
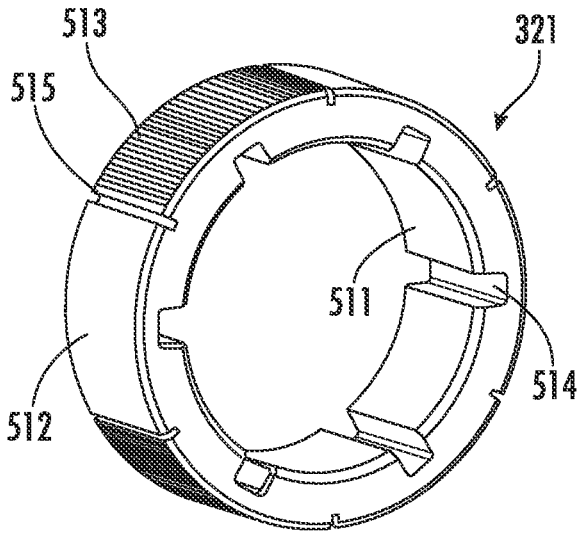
FIG. 12 shows a perspective view of an identification ring of the color-coded cable identification assembly according to the first embodiment of the present disclosure.
Figure 13:
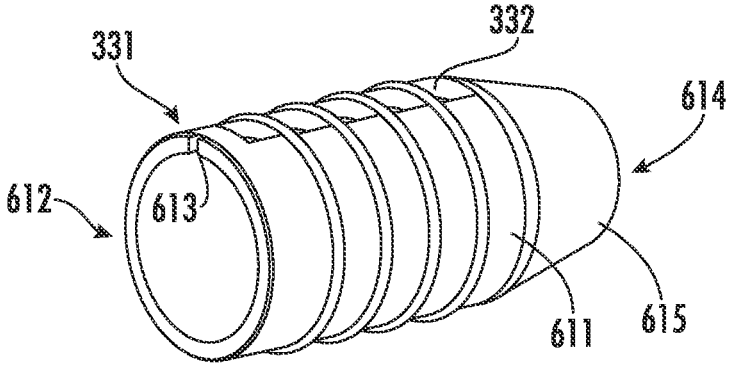
FIG. 13 shows a perspective view of a sheath of the color-coded cable identification assembly according to the first embodiment of the present disclosure.
Figure 14:
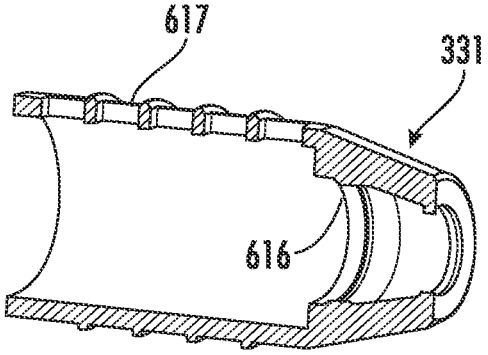
FIG. 14 shows a cross-sectional view of the sheath shown in FIG. 13.

The specific structure of each member of the cable identification assembly 310 according to an embodiment of the present disclosure will be described with reference to FIGS. 11 to 14, wherein FIG. 11 shows the specific structure of the sleeve 311 according to the first embodiment of the present disclosure; FIG. 12 shows the specific structure of the identification ring 321 according to the first embodiment of the present disclosure; and FIGS. 13 and 14 show the specific structure of the sheath 331 according to this embodiment of the present disclosure.

As shown in FIG. 11, the sleeve 311 according to this embodiment of the present disclosure includes a body 411 for mounting and positioning the identification ring 321. The body 411 has an elongated cylindrical shape, so that the cable 301 can extend through the body 411 and the plurality of identification rings 321 can be sequentially mounted over the body 411 along the axial direction thereof. The first end of the body 411 may be provided with a first step portion 412. The first step portion may have a cylindrical shape, and the diameter of the first step portion is larger than that of the body 411 to restrict movement of the plurality of identification rings 321 toward the first end of the body 411 along the axial direction thereof. The first end of the body 411 may also be provided with a second step portion 413 adjacent to the first step portion 412. The second step portion 413 may have a cylindrical shape, and the diameter of the second step portion 413 is larger than that of the first step portion 412 to restrict movement of the sheath 331 toward the first end of the body 411 along the axial direction thereof. The second end of the body 411 opposite to the first end may be provided with a fastening portion 414. At least a portion of the fastening portion 414 may have a frusto-conical shape and be composed of a plurality of elastic fingers 415, When the sheath 331 is mounted over the sleeve 11, the plurality of elastic fingers 415 of the fastening portion 414 can contract radially inwardly under the action of the sheath 331, thereby fixing the sleeve 311 and thus the entire cable identification assembly 310 over the cable 301. The sleeve 311 may further include an annular protrusion 416 located between the second end of the body 411 and the elastic fingers 415 of the fastening portion 414 and extending in the circumferential direction of the body 411. The annular protrusion 416 of the sleeve 311 is configured to cooperate with the annular protrusion 616 disposed on the inner surface of the sheath 331 so as to position the sheath 331 over the sleeve 311, which will be described in further detail below.

The sleeve 311 according to this embodiment of the present disclosure may include a first positioning and indicating element for the plurality of identification rings 321. As shown in FIG. 11, the first positioning and indicating element may be configured as a first key 417 that protrudes from the outer surface of the body 411 and extends in the axial direction of the body 411. The first key 417 may prevent the plurality of identification rings 321 from rotating around the central axis of the body 411 to position the plurality of identification rings 321, and the first key 417 may indicate the position where the color code formed by the plurality of identification rings 321 should be located. The sleeve 311 according to this embodiment of the present disclosure may further include a second positioning and indicating element for the sheath 331. As shown in FIG. 11, the second positioning and indicating element may be configured as a second key 418 that protrudes from the circumferential surface of the first step portion 412 and extends in the axial direction of the first step portion 412. The second key 418 may prevent the sheath 331 from rotating around the central axis of the body 411 to position the sheath 331, and the second key may indicate the position where the viewing window 332 of the sheath 331 should be located. The first key 417 and the second key 418 may be aligned with each other, so that upon the cable identification assembly 310 has been assembled, the color code formed by the plurality of identification rings 321 can be exposed in the viewing window 332 of the sheath 331. In one embodiment according to the present disclosure, the sleeve 311 may be made of plastic, for example, formed from plastic by molding. In other embodiments according to the present disclosure, the sleeve 311 may be made of metal (e.g., aluminum or the like) or any other suitable material.

As shown in FIG. 12, the identification ring 321 according to this embodiment of the present disclosure includes an inner surface 511 and an outer surface 512. The outer surface 512 of the identification ring 321 may include a predetermined number (shown as six in FIG. 12) of sections 513 that are distributed along the circumferential direction of the identification ring 321. Each section 513 may have a predetermined color, such as any one of white, red, blue, green, black, yellow, orange, brown, violet, slate, or other colors. The inner surface 511 of the identification ring 321 may include grooves 514 with a number equal to the predetermined number of sections 513. The position of each groove 514 may be substantially aligned with the central position of the corresponding section 513 in the circumferential direction to indicate the position of the corresponding section 513 and to cooperate with the first key 417 of the body 411 of the sleeve 311 to position the corresponding section 513.

Each section 513 may be made of a material that is same as or different from the material of the identification ring 321, and may be formed on the identification ring 321 in various different manners.

In one embodiment according to the present disclosure, the identification ring 321 may be made of plastic, and each section 513 may be made of plastic, silicone rubber, or other materials having a required color. In this embodiment, it is possible to firm the identification ring 321 by molding at first, and then form each section 513 by secondary molding with plastic, silicone rubber, or other materials having a required color on the identification ring 321 that has been formed. In order to avoid damage to the identification ring 321 that has been formed by molding due to high temperature during secondary molding of each section 513, it is advantageous that the material of each section 513 is selected to have a melting point lower than that of the material of the identification ring 513. In addition, in order to facilitate forming the plurality of sections 513 with various predetermined colors by secondary molding on the identification ring 321, slits 515 for separating each section 513 may be provided on the outer surface 512 of the identification ring 321, so that each section 513 is formed between two adjacent slits 515. Besides facilitating the molding of the plurality of sections 513, the slits 515 may also be used as boundaries of the plurality of sections 513, so as to clearly display each section 513.

In another embodiment according to the present disclosure, the identification ring 321 may be made of plastic, and each section 513 may be made of plastic, silicone rubber, or other materials having a required color. In this embodiment, it is possible to pre-mold the identification ring 321 and each section 513 respectively at first, and then fax each section 513 that has been pre-molded on the identification ring 321 in various ways. For example, it is possible to bond each section 513 that has been pre-molded to the identification ring 321 by glue; and it is possible to provide a recessed area for receiving each section 513 on the outer surface 512 of the identification ring 321, and then embed and hold each section 513 that has been pre-molded in the corresponding recessed area, for example, by way of a friction fit or interference fit between each section 513 and the recessed area, or the like. Other suitable means (e.g. mechanical connection, fusion and the like) may also be used to fix each section 513 that has been pre-molded on the identification ring 321, In this embodiment, slits 515 for separating each section 513 may be provided on the outer surface 512 of the identification ring 321, so that each section 513 is provided between two adjacent slits 515. The slits 515 may be used as boundaries of the plurality of sections 513, so as to clearly display each section 513.

In a further embodiment according to the present disclosure, the identification ring 321 may be made of metal (e.g, light metal such as aluminum), and each section 513 may be made of plastic, silicone rubber, or other materials having a required color. In this embodiment, it is possible to make the identification ring 321 with a metal material at first, and then form the section 513 by overmolding on the identification ring 321 with plastic, silicone rubber, or other materials having a required color. It is also possible to make the identification ring 321 with a metal material and pre-mold each section 513 with plastic, silicone rubber or other materials having a required color at first, and then fix each section 513 that has been pre-molded on the identification ring 321 in various ways. For example, each section 513 that has been pre-molded may be bonded to the identification ring 321 by glue. It is possible to provide a recessed area for receiving each section 513 on the outer surface of the identification ring 321, and then embed and hold each section 513 in the corresponding recessed area, for example, by way of a friction fit or interference fit between each section 513 and the recessed area, or the like. Other suitable means (e.g. mechanical connection, fusion or the like) may also be used to fix each section 513 that has been pre-molded on the identification ring 321. In this embodiment, slits 515 for separating each section 513 may be provided on the outer surface 512 of the identification ring 321, so that each section 513 is provided between two adjacent slits 515. The slits 515 may be used as boundaries of the plurality of sections 513, so as to clearly display each section 513.

In still another embodiment according to the present disclosure, each section 513 may be formed by directly spraying a corresponding color on the identification ring 321. In this embodiment, in order to facilitate forming a plurality of sections 513 having various predetermined colors by spraying on the identification ring 321, slits 315 for separating each section 513 may be provided on the outer surface 512 of the identification ring 321, so that each section 513 is sprayed between two adjacent slits 515. In addition to facilitating the spray forming of the plurality of sections 513, the slits 515 may also be used as boundaries of the plurality of sections 513, so as to clearly display each section 513.

As shown in FIGS. 13 and 14, the sheath 331 according to the first embodiment of the present disclosure includes a cylindrical body 611, so that the sheath 331 can be mounted over the sleeve 311 and clamp the identification ring 321 between the sheath 331 and the sleeve 311. The body 611 of the sheath 331 includes a viewing window 332 for exposing the color code formed by the plurality of identification rings 321. The viewing window 332 may include a plurality of openings, each of which exposes at least a portion of a corresponding section 513 of one identification ring 321, so as to display the color of this corresponding section (as shown in FIG. 10). The viewing window 332 may also include only one opening, which can expose the corresponding sections 513 of all identification rings 321, so as to display the colors of the corresponding sections 513 of all identification rings 321. The inner surface of the first end 612 of the body 611 of the sheath 331 may be provided with a groove 613. The position of the groove 613 may correspond to the central position of the viewing window 332 in the circumferential direction, so as to indicate the position of the viewing window 332. When the sheath 331 is mounted over the sleeve 311, the groove 613 receives the second key 418 on the first step portion 412 of the sleeve 311 so as to prevent the sheath 331 from rotating around the body 411 of the sleeve 311 and position the viewing window 332 of the sheath 331 at a predetermined position. The second end 614 of the body 611 of the sheath 331 may be provided with a tapered portion 615. The tapered portion 615 may have a frusto-conical shape for contracting the elastic fingers 415 of the fastening portion 414 of the sleeve 311 radially inwardly when the sheath 331 is mounted over the sleeve 311, thereby fixing the sleeve 311 and thus the entire cable identification assembly 310 over the cable 301. The inner surface of the tapered portion 615 of the sheath 331 may be provided with an annular protrusion 616 extending along the circumferential direction. When the sheath 331 is mounted over the sleeve 311, the annular protrusion 616 of the sheath 331 passes over the annular protrusion 416 of the sheath 311, thereby positioning the sheath 331 over the sleeve 311 and preventing the sheath 331 from sliding off the sleeve 311 in the axial direction by means of the interference fit between the annular protrusion 616 and the annular protrusion 416. In addition, the outer surface of the body 611 of the sheath 331 may include one or more annular ribs 617 extending along the circumferential direction of the body 611. The annular rib 617 may not only increase the strength of the sheath 331, but also increase the friction of the outer surface of the sheath 331, so as to facilitate the assembly and disassembly of the sheath 331. In one embodiment according to the present disclosure, the sheath 331 may be made of plastic, for example, formed from plastic by molding. In other embodiments according to the present disclosure, the sheath 331 may be made of metal (e.g., aluminum, or the like) or any other suitable material.

Figure 15A:
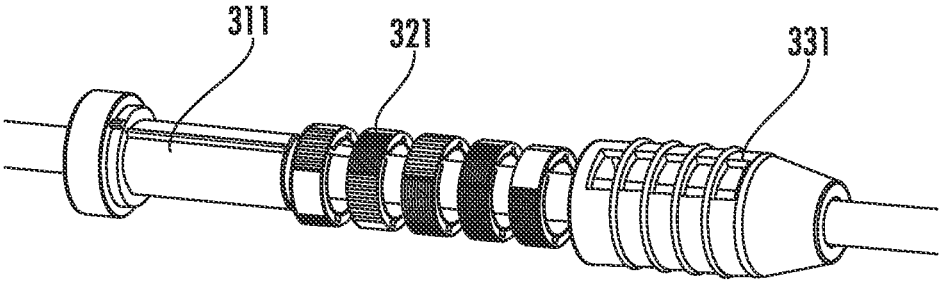
FIGS. 15A to 15C show schematic views of the assembly of the color-coded cable identification assembly according to the first embodiment of the present disclosure.
Figure 15B:
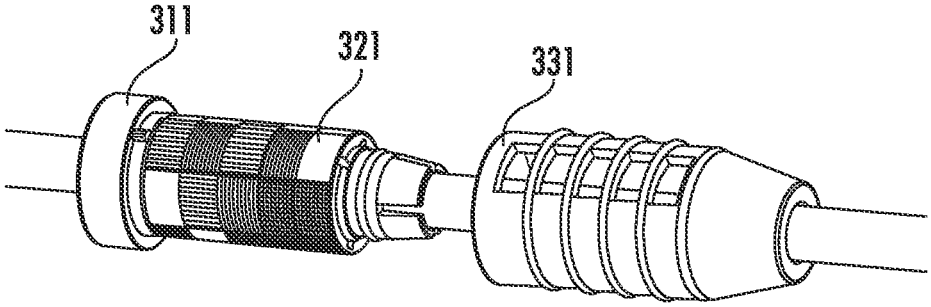
Figure 15C:
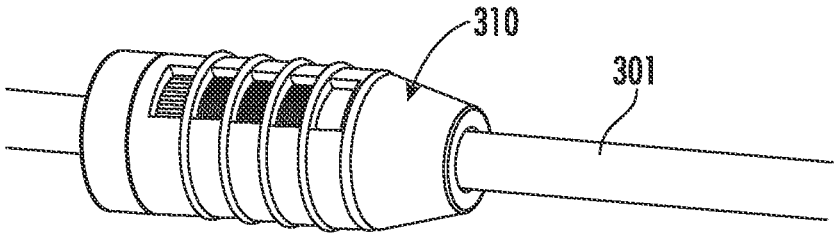

A method of identifying a cable using the cable identification assembly 310 according to the first embodiment of the present disclosure will be described with reference to FIGS. 15A to 15C. As shown in FIG. 15A, in step i, sequentially mount the sleeve 311, a plurality of identification rings 321 (shown as five identification rings 321 in FIGS. 15A to 15C), and the sheath 331 of the cable identification assembly 310 over the cable 301 with the cable extending therethrough. As shown in FIG. 15B, in step ii, select a required color of a first one of the plurality of identification rings 321 that will be used to form a predetermined color code, rotate the section having the required color of the first identification ring to a position corresponding to the first key 417 of the sleeve 311, receive the first key 417 into the groove of the first identification ring that corresponds to the section having the required color, and slide the first identification ring along the first key 417 to a position abutting against the first step portion 412 of the sleeve 311; then, select a required color of the second one of the plurality of identification rings 321 that will be used to form the predetermined color code, rotate the section having the required color of the second identification ring to the position corresponding to the first key 417 of the sleeve 311, receive the first key 417 into the groove of the second identification ring that corresponds to the section having the required color, and slide the second identification ring along the first key 417 to a position abutting against the first identification ring; repeat the above-described operations until all the identification rings 321 are slidingly mounted over the sleeve 311 along the first key 417. As shown in FIG. 15C, in step iii, rotate the sheath 331 to a position where the groove 613 of the sheath 331 is substantially aligned with the second key 418 of the sleeve 311, receive the second key 418 of the sleeve 311 into the groove 613 of the sheath 331, and slide the sheath 331 along the second key 418 to a position abutting against the second step portion 413. In this way, the color code formed by the plurality of the identification rings 321 will be exposed in the viewing windows 332 of the sheath 331. In addition, when the sheath 331 abuts against the second step portion 413 of the sleeve 311, the annular protrusion 616 of the sheath 331 passes over the annular protrusion 416 of the sleeve 311, thereby positioning the sheath 331 over the sleeve 311. At the same time, the tapered portion 615 of the sheath 331 contracts the elastic fingers 415 of the fastening portion 414 of the sleeve 311 radially inwardly, thereby fixing the sleeve 311 and thus the entire cable identification assembly 310 over the cable 301.

When it is necessary to adjust the plurality of identification rings of the cable identification assembly 310 that has been assembled or pre-assembled over the cable to form a new color code, it is possible to remove the sheath 331 from the sleeve along an axial direction away from the sleeve 311 at first, remove the plurality of identification rings 321 from the first key 417 of the sleeve 311 along the axial direction away from the sleeve 311, and then repeat the step ii to reselect the section of each identification ring 321 that has a color required to form another predetermined color code and mount the plurality of identification rings 321, and repeat the step iii to mount the sheath 331.

The cable identification assembly 310 according to the present disclosure may be easily assembled and disassembled and may also be conveniently adjusted, which can greatly save the installation time of workers and thus reduce the labor cost and the possibility of making mistakes. In addition, since the cable identification assembly 310 according to the present disclosure may include a plurality of identification rings 321, each of which may include a plurality of sections 513 and thus may have a plurality of different colors, the cable identification assembly 310 may form dozens of or even hundreds of different color codes by selecting the section 513 of each identification ring 321, so that all the color codes required by the user can be realized by a fixed number of identification rings 321, which significantly increases the versatility of the cable identification assembly 310 according to the present disclosure. The cable identification assembly 310 according to the present disclosure may also be pre-assembled over the cable 301 and form a part of the cable 301 in the factory, thus avoiding the need to separately prepare a tool kit for the cable identification assembly. In addition, compared with a conventional adhesive tape, the members of the cable identification assembly 310 according to the present disclosure may be made of plastic, metal, silicone rubber, or other materials respectively, so that it is possible to meet the requirements of anti-ultraviolet, anti-aging and the like, and it is also possible to reuse.

Figure 16:
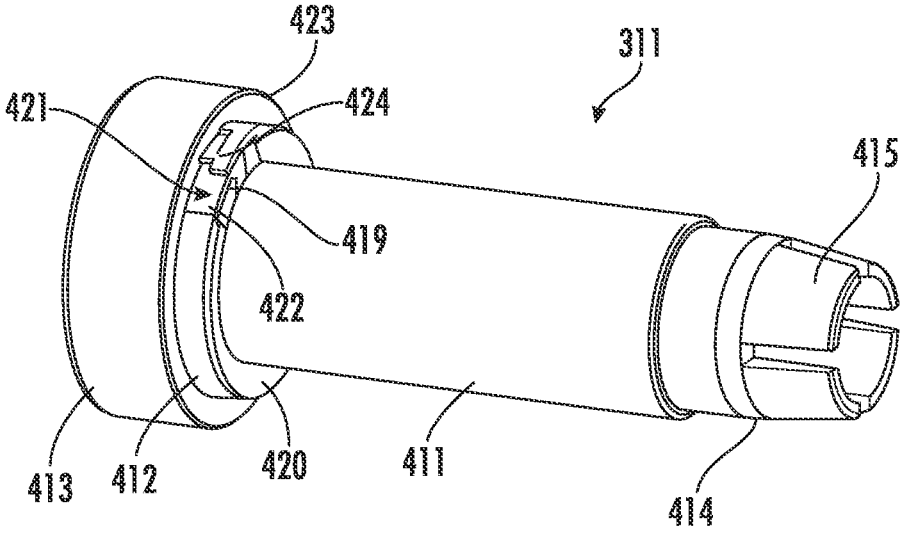
FIG. 16 shows a perspective view of a sleeve of the color-coded cable identification assembly according to a second embodiment of the present disclosure.
Figure 17A:
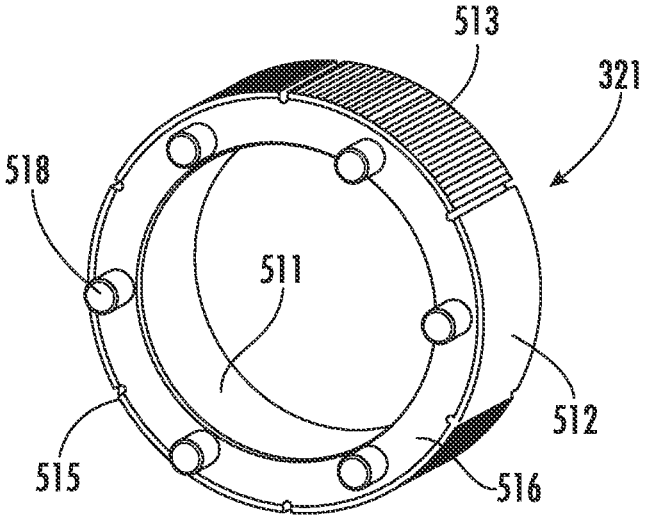
Figure 17B:
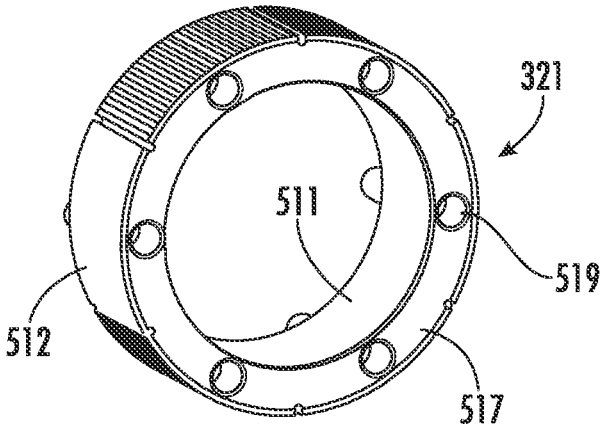
Figure 18:
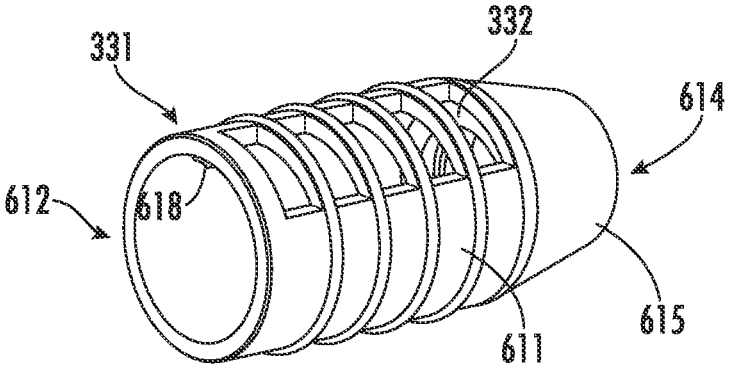
FIG. 18 shows a perspective view of the sheath of the color-coded cable identification assembly according to the second embodiment of the present disclosure.
Figure 19:
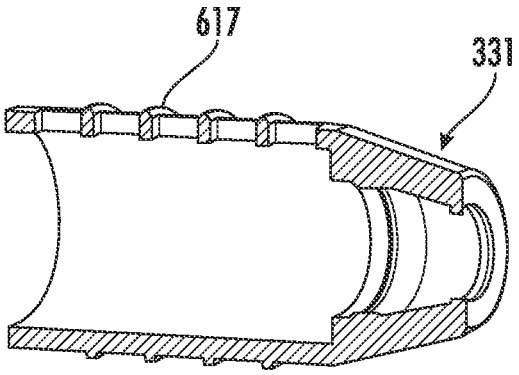
FIG. 19 shows a cross-sectional view of the sheath shown in FIG. 18.

The specific structure of various members of the cable identification assembly 10 according to the second embodiment of the present disclosure will be described with reference to FIGS. 16 to 19, wherein FIG. 16 shows the specific structure of the sleeve 311 according to another embodiment of the present disclosure; FIGS. 17A and 17B show the specific structure of the identification ring 321 according to another embodiment of the present disclosure; FIGS. 18 and 19 show the specific structure of the sheath 331 according to another embodiment of the present disclosure. For the sake of brevity, the same structure as the earlier-described embodiment according to the present disclosure will not be described in detail, and only the structure different from that embodiment according to the present disclosure will be described.

As shown in FIG. 16, the sleeve 311 according to the second embodiment of the present disclosure includes: a body 411 for mounting the identification ring 321, wherein the body 411 has an elongated cylindrical shape; a first step portion 412 provided at a first end of the body 412 and a second step portion 413 adjacent to the first step portion 412, wherein the diameter of the first step portion 412 is larger than that of the body 411 to restrict movement of the identification ring 321 toward the first end of the body 411 along the axial direction thereof, and the diameter of the second step portion 413 is larger than that of the first step portion 412 to restrict movement of the sheath 331 toward the first end of the body 411 along the axial direction thereof; and a fastening portion 414 provided at a second end of body 411, at least a portion of which may have a frusto-conical shape and be composed of a plurality of elastic fingers 415. The elastic fingers 415 of the fastening portion 414 are configured to contract radially inwardly when the sheath 331 is mounted on the sleeve 311, thereby fixing the sleeve 311 and thus the entire cable identification assembly 310 on the cable 301.

Unlike the earlier-described embodiment according to the present disclosure, the first positioning and indicating element of the sleeve 311 according to this embodiment of the present disclosure is configured as a hole 419 provided on the end surface of the first step portion 412. The hole 419 may position the identification ring 321 by cooperating with a post provided on the end surface of the identification ring 321 and indicate the position where the color code formed by the plurality of identification rings 321 should be located. Specifically, as shown in FIGS. 17A and 17B, the identification ring 321 according to this embodiment of the present disclosure includes an inner surface 511, an outer surface 512, a front end surface 516 and a rear end surface 517. The outer surface 512 of the identification ring 321 may include a predetermined number (six shown in FIGS. 17A and 17B) of sections 513 that are distributed along a circumferential direction of the identification ring 321. Each section 513 may have a predetermined color. The front end surface 516 of the identification ring 321 is provided with posts 518 with a number equal to the predetermined number of sections 513, wherein each post 518 protrudes from the front end surface 516 of the identification ring 321 and the position of each post may substantially align with a central position of the corresponding section 513 along a circumferential direction. The rear end surface 517 of the identification ring 321 is provided with holes 519 corresponding to the posts 518 of the front end surface 516 of the identification ring 321 in position and number, for receiving the posts 518 of another identification ring 321. During the assembly of the cable identification assembly 310, it is necessary to select a required color of the first identification ring among the plurality of identification rings 321 that will be used to form a predetermined color code, and rotate the section having the required color of the first identification ring to a position corresponding to the hole 419 on the end surface of the first step portion 412 of the sleeve 311, and insert the post 518 of the first identification ring corresponding to the section having the required color into the hole 419 of the sleeve 311, In order to prevent other posts 518 on the front end surface 516 of the first identification ring from interfering with the end surface of the first step portion 412 of the sleeve 311, the end surface of the first step portion 412 of the sleeve 311 is further provided with an arc-shaped groove 420 for receiving other posts 518 on the front end surface 516 of the first identification ring. Such design enables the hole 419 on the end surface of the first step portion 412 of the sleeve 311 to produce a better indicating effect, which can remind the workers to insert the post 518 of the first identification ring corresponding to the section having the required color into the hole 419, so that the section having the required color can be exposed in the viewing window 332 of the sheath 331, Of course, in another embodiment according to the present disclosure, the end surface of the first step portion 412 of the sleeve 311 may also be provided with holes 419 corresponding to the posts 518 on the front end surface 516 of the identification ring 321 in position and number.

In addition, unlike the earlier-described embodiment according to the present disclosure, the second positioning and indicating element of the sleeve 311 according to this embodiment of the present disclosure is configured as a bayonet arrangement 421 provided on the circumferential surface of the first step portion 412. The bayonet arrangement 421 may position the sheath 331 by cooperating with the protrusion provided on the inner surface of the first end 612 of the sheath 331 and indicate the position where the viewing window of the sheath 331 should be located. Specifically, as shown in FIG. 16 the bayonet arrangement 421 includes a cutout 422 extending along the axial direction of the first step portion 412 and a recessed portion 423 extending along the circumferential direction of the first step portion 412. Correspondingly, as shown in FIGS. 18 and 19, the inner surface of the first end 612 of the sheath 331 according to this embodiment of the present disclosure is provided with a protrusion 618. During the assembly of the cable identification assembly 310, it is possible to push the protrusion 618 of the sheath 331 into the cutout 422 of the sleeve 311 along the axial direction at first, and then rotate the sheath 331 along the circumferential direction to rotate and hold the protrusion 618 in the recessed portion 423 of the sleeve 311. The recessed portion 423 can restrict movement of the sheath 331 along the axial direction. In addition, in order to prevent the sheath 331 from disengaging from the sleeve 311 due to the reverse rotation, a stopper 424 is provided in the recessed portion 423 of the bayonet arrangement 421. When the sheath 331 is rotated along the circumferential direction, the protrusion 618 of the sheath 331 needs to pass over the stopper 424 to enter the recessed portion 423 of the sleeve 411. In this way, when the sheath 331 reversely rotates unintentionally, it is possible to prevent the sheath 331 from coming Out of the recessed portion 423 and thus preventing the sheath 331 from disengaging from the sleeve 311 by an interference fit between the stopper 424 of the sleeve 311 and the protrusion 618 of the sheath 331.

In order to expose the color code formed by the plurality of identification rings 321 in the viewing window 332 of the sheath 331, the position of the bayonet arrangement 421 of the sleeve 311 may substantially correspond to that of the hole 419. Meanwhile, the position of the protrusion 618 of the sheath 331 is provided to make the color code formed by the plurality of identification rings 321 can be accurately exposed in the observation window 332 of the sheath 331 when the protrusion 618 is held in the recessed portion 423 of the sleeve 311.

Figure 20A:
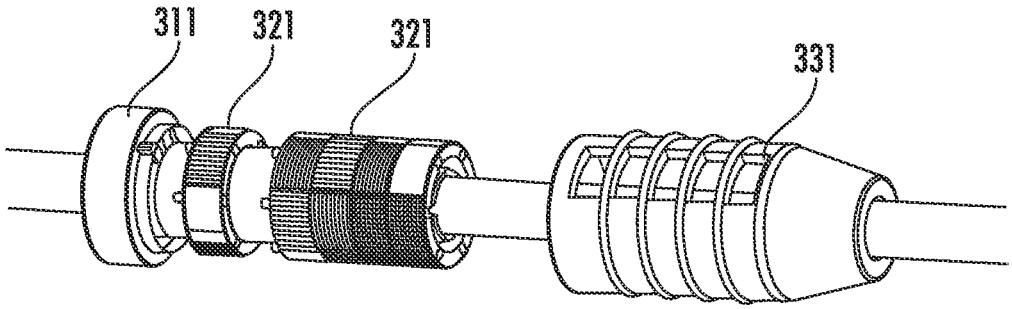
FIGS. 20A to 20C show schematic views of assembling the color-coded cable identification assembly according to the second embodiment of the present disclosure.
Figure 20B:
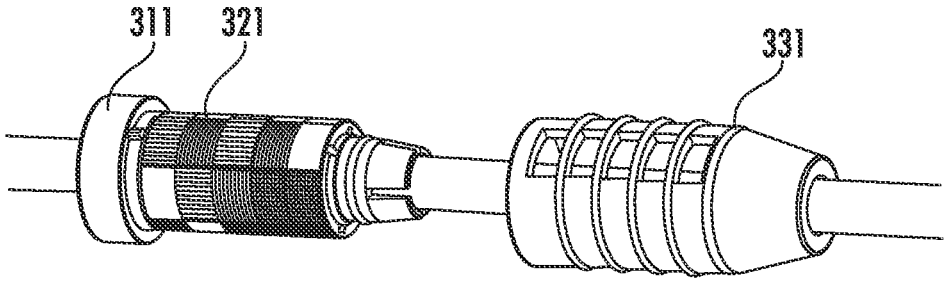
Figure 20C:
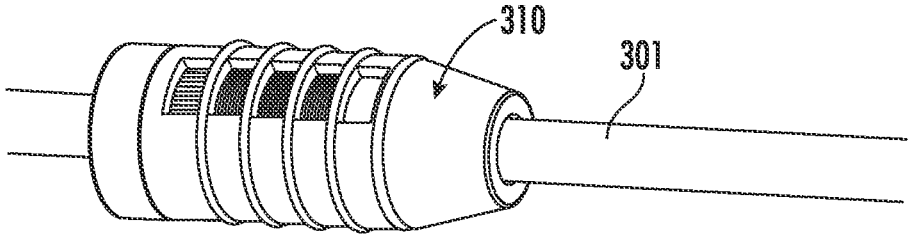

A method of identifying a cable using the cable identification assembly 10 according to the second embodiment of the present disclosure will be described with reference to FIGS. 20A to 20C. As shown in FIG. 20A, in step i, sequentially mount the sleeve 311, a plurality of identification rings 321 (shown as five identification rings 321 in FIGS. 20A to 20C), and the sheath 331 of the cable identification assembly 310 over the cable 301 with the cable extending therethrough. As shown in FIG. 20B, in step ii, select a required color of the first one of the plurality of identification rings 321 that will be used to form a predetermined color code, rotate the section having the required color of the first identification ring to a position corresponding to the hole 419 of the sleeve 311, and insert the post 518 of the first identification ring corresponding to the section having the required color into the hole 419 of the sleeve 311; then, select a required color of the second one of the plurality of identification rings 321 that will be used to form the predetermined color code, and rotate the section having the required color of the second identification ring to a position corresponding to the section having the required color of the first identification ring, and insert the post 518 of the second identification ring into the hole 519 of the first identification ring; repeat the above-described operations until all identification rings 521 are mounted over the sleeve 11. As shown in FIG. 20C, in step iii, rotate the sheath 331 to a position where the protrusion 618 of the sheath 331 is substantially aligned with the cutout 422 of the bayonet arrangement 421 of the sleeve 311, and push the protrusion 418 of the sheath 331 into the cutout 422 of the sleeve 311 until the sheath 331 abuts against the second step portion 413 of the sleeve 311, and then rotate the sheath 331 along the circumferential direction, so that the protrusion 618 of the sheath 31 passes over the stopper 424 of the sleeve 311 to enter the recessed portion 423 of the sleeve 311. At this time, the color code formed by the plurality of the identification rings 321 will be exposed in the viewing windows 332 of the sheath 331; and at this time, the sheath 331 is positioned over the sleeve 311, and the tapered portion 615 of the sheath 331 contracts the elastic fingers 415 of the fastening portion 414 of the sleeve 311 inwardly, thereby fixing the sleeve 311 and thus the entire cable identification assembly 310 over the cable 301.

When it is necessary to adjust the plurality of identification rings of the cable identification assembly 310 according to this embodiment of the present disclosure that has been assembled or pre-assembled over the cable to form a new color code, the sheath 331 may be first rotated reversely, so that the protrusion 618 of the sheath 331 passes over the stopper 424 so as to move out of the recessed portion 423 of the sleeve 311. Then, the sheath 331 is removed from the sleeve 311 along the axial direction away from the sleeve 311, and the plurality of identification rings 321 are separated from each other along the axial direction away from the sleeve 311. Afterwards, the step ii is repeated to reselect a section of each identification ring 321 that has a required color that will be used to form another predetermined color code and mount the plurality of identification rings 321, and the step iii is repeated to mount the sheath 331.

Compared with the cable identification assembly according to the earlier-described embodiment of the present disclosure, the cable identification assembly according to this embodiment of the present disclosure may be more convenient in disassembling the cable identification assembly and adjusting its color code, because in this embodiment according to the present disclosure, it is only necessary to separate the identification rings 321 from each other, and it is not necessary to remove each identification ring 321 from the first key 417 of the sheath 311 as in the first embodiment of the present disclosure.

Although in the embodiments shown in the accompanying drawings, the cable identification assembly 310 includes five identification rings 321, each of which includes six sections 513, the present disclosure is not limited thereto. The cable identification assembly 310 may include any other number (e.g., two, three, four, six, seven, eight or the like) of identification rings 321, and each identification ring 321 may include a plurality of sections (e.g., two, three, four, six, seven, eight or the like) in the same or different numbers and thus have a plurality of colors in the same or different numbers as needed. In addition, the types of colors provided on the plurality of sections of each identification ring 321 may also be different from the types of colors provided on the plurality of sections of another identification ring 321.

In another embodiment according to the present disclosure, the cable identification assembly 310 may include a plurality of identification rings 321, each of which may have only one color. In this embodiment, a predetermined color code may be formed by selecting a plurality of identification rings 321 having different colors so as to identify the cable.

Figure 21:
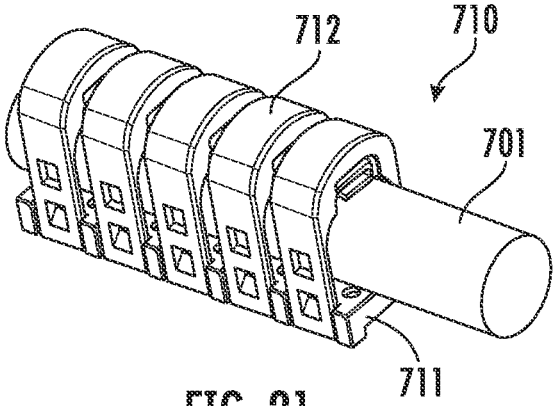
FIG. 21 shows a perspective view of a color-coded cable identification assembly according to one embodiment of the present disclosure.

Referring now to FIG. 21, a color-coded cable identification assembly 710 according to another embodiment of the present disclosure is shown. The cable identification assembly 710 may include a support element 711 and a plurality of identification elements 712. Each of the plurality of identification elements 712 can be locked with the support element 711 to form a cable identification assembly 710, and the plurality of identification elements 712 fixedly mount the cable identification assembly 710 to the cable 701 by locking the cable 701 between the support element 711 and the plurality of identification elements 712. Each identification element 712 has a predetermined color, so that the plurality of identification elements 712 can form a predetermined color for example in a predetermined color array, so as to identify the cable 701.

Figure 22A:
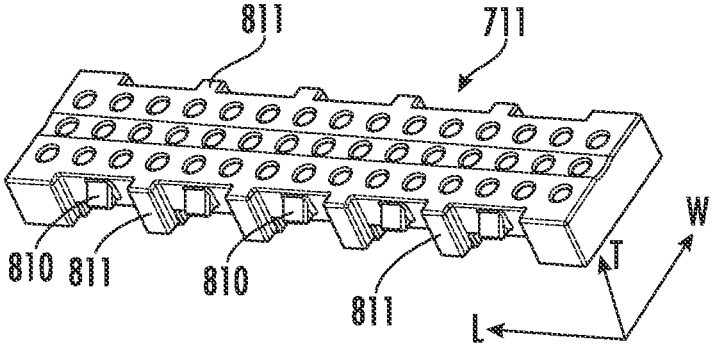
Figure 22B:
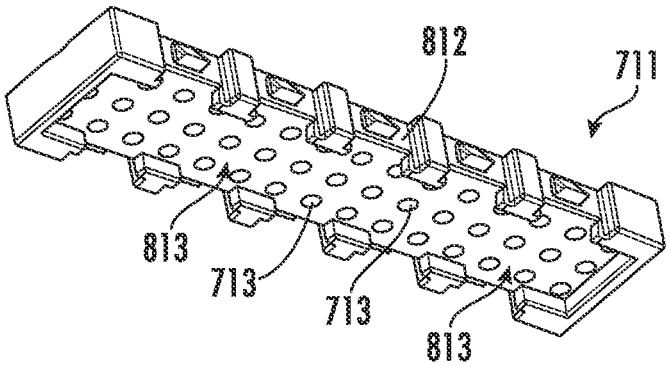

Referring to FIGS. 22A and 22B, the specific structure of the support element 711 of the cable identification assembly 710 according to the present disclosure is shown. As shown in FIGS. 22A and 22B, the support element 711 may be constructed in a plate shape. The support element may have a length direction L, a width direction W, and a thickness direction T, and may include a front surface, a back surface, two opposite end surfaces, and two opposite side surfaces. The support element 711 may include a plurality of pairs of first locking members 810 that are adapted to lock the plurality of identification elements 712 on the support element 711. The plurality of pairs of first locking members 810 may be arranged along the length direction L of the support element, and each pair of first locking members 810 are respectively disposed on two opposite side surfaces of the support element. In the embodiment shown in FIGS. 22A and 22B, each pair of first locking members 810 are constructed as protrusions provided on two opposite side surfaces of the support element. Each protrusion may protrude outward from a side surface of the support element along the width direction W thereof, and each protrusion may have a slope extending obliquely from the front surface toward the back surface of the support element, such that each protrusion is generally wedge-shaped. Of course, the present disclosure is not limited to this. The protrusion may have a configuration in other shapes. For example, the protrusion may have a hemispherical shape, or a quarter-spherical shape with a flat bottom surface. In addition, each pair of first locking members 710 may also be constructed as holes or other configurations provided on two opposite side surfaces of the support element, which will be discussed further below.

In some embodiments, the support element 711 may further include a plurality of pairs of flanges 811 provided on two opposite side surfaces of the support element. The plurality of pairs of flanges 811 may be alternately arranged with the first locking members 810 in the length direction L of the support element 711, to allow that each pair of first locking members is located between two adjacent pairs of flanges, so that each identification element 712 can be locked between two adjacent pairs of flanges 811. In one embodiment according to the present disclosure, each flange may extend outward from the side surface of the support element 711 in the width direction W thereof, and extend beyond the back surface of the support element 711 in the thickness direction T thereof, so that it is possible to define a first recess 812 for receiving an identification element between two adjacent pairs of flanges 811 and a second recess 813 on the back surface of the support element 711 (as shown more clearly in FIG. 22B). Such flanges 811 can achieve the following advantages: 1) when the identification element 712 is installed, two adjacent flanges 811 may restrain and guide the identification element 712, so as to facilitate the installation of the identification element 712; 2) each flange 811 may be configured to space apart the plurality of identification elements 712 to facilitate the individual assembly and disassembly of each identification element; 3) when unlocking each identification element 712 from the support element 711, the second recess 813 formed by the flanges 811 on the back surface of the support element 711 may serve as a force applying point for the operator. Specifically, when the identification element 712 is locked on the support element 711, due to the presence of the flanges 813, the free end 821 of the identification element 712 may also extend beyond the back surface of the support element 711 in the thickness direction T thereof. In this way, when the operator intends to unlock the identification element 712 from the support element 711, the operator may extend his finger into the second recess 813, and place his finger on a portion of the identification element 712 that extends beyond the back surface of the support element 711. Then, the operator pulls the portion of the free end 821 of the identification element 712 outward along the width direction W of the support element 11, so that the identification element 712 may be unlocked from the support element 711, thereby rapidly removing the identification element 712 from the support element 711.

In some embodiments, the support element 711 may also be provided with a plurality of holes 713 that penetrate through an entire thickness of the support element 711. In this way, the material and manufacturing cost of the support element 711 can be saved, and the weight of the support element 711 can also be reduced.

In embodiments according to the present disclosure, the support element 711 may be made from plastic. For example, the support element 711 may be made by molding using a plastic material. However, the present disclosure is not limited to this. The support element 711 may be made from other materials (for example, light metal materials such as aluminum). For example, the support element 11 may be made by machining using light metal materials.

Referring to FIGS. 23A to 23E, the specific structure of the identification element 712 of the cable identification assembly 710 according to the present disclosure is shown. In the embodiment shown in FIGS. 23A to 23E, each identification element 712 may have a U shape, which includes two legs 822 and 823 and a curved portion 824 connecting the two legs 822 and 823. Each identification element 712 may include a pair of second locking members 825, which may be respectively disposed on the two legs 822 and 823 of the U-shaped identification element 712 (see FIG. 23B), and the pair of second locking members are adapted to be locked with a corresponding pair of first locking members 810 of the support element 711. In the embodiments shown in FIGS. 23A to 23E, each second locking member 825 of the identification element 712 is constructed as a hole adapted to receive the protrusion of the support element 711. The hole may be a quadrilateral hole, such as a square hole or a rectangular hole, to receive a wedge-shaped protrusion as shown in FIGS. 22A and 22B. However, the present disclosure is not limited to this. The hole of the identification element 712 may have various shapes to accommodate different shapes of protrusions of the support element 711. In one embodiment according to the present disclosure, the protrusion of the support element 711 may have a hemispherical shape, and accordingly, the hole of the identification element 712 may be a circular hole. In another embodiment according to the present disclosure, the protrusion of the support element 711 may have a quarter-spherical shape with a flat bottom surface, and accordingly, the hole of the identification element 712 may be a semi-circular hole. In addition, in the case where the first locking member 810 of the support element 711 is constructed as a hole, the second locking member of the identification element 712 may be constructed as a protrusion that can be received in the hole of the support element 711, for example constructed as a semispherical protrusion or the like disposed on the inner surfaces of the two legs 822 and 823 of the identification element 712.

In order to facilitate locking a corresponding pair of first locking members 810 of the support element 711 with the pair of second locking members 825 of the identification element 712, the two legs 822 and 823 of the identification element 712 may be constructed as elastic legs which may be elastically deformed outward, and may be restored to an initial position when a corresponding pair of first locking members 810 of the support element 711 are locked with the pair of second locking members 825 of the identification element 712, so as to maintain the locking of the support element 711 and the identification element 712.

In one embodiment according to the present disclosure, the inner surface of each identification element 712 may be provided with an elastic structure 826. The elastic structure 826 may abut against the cable 701 with an elastic force when each identification element 712 is locked with the support element 711, so that it is possible to firmly hold the cable 701 between the support element 711 and the identification element 712 and prevent the cable identification element 710 from sliding on the cable 701. The elastic structure 826 may be disposed at the curved portion 824 of the identification element 712. In the embodiment shown in FIGS. 23A and 23B, the elastic structure 826 is constructed as a cantilever structure bent multiple times (for example, as a C-shape or U-shape). The cantilevered structure bent multiple times has a flat surface 827 in contact with the cable 701, which may be in contact with the circular outer surface of the cable 701 and elastically deformed under the compression of the circular outer surface of the cable 701 (see FIG. 23E) when the identification element 712 is locked with the support element 711, thereby producing an elastic restoring force toward the cable 701 so as to firmly hold the cable 701 between the support element 711 and the elastic structure 826 of the identification element 712, In the embodiment shown in FIG. 23C, the elastic structure 826 is constructed as two opposite cantilevered sections. At least a portion of each cantilevered section includes a flat surface 828 that is in contact with the circular outer surface of the cable 701 and elastically deformed under the compression of the circular outer surface of the cable 701 when the identification element 712 is locked with the support element 711, thereby producing an elastic restoring force toward the cable 701 so as to firmly hold the cable 701 between the support element 711 and the elastic structure 726 of the identification element 712.

Figure 23A:
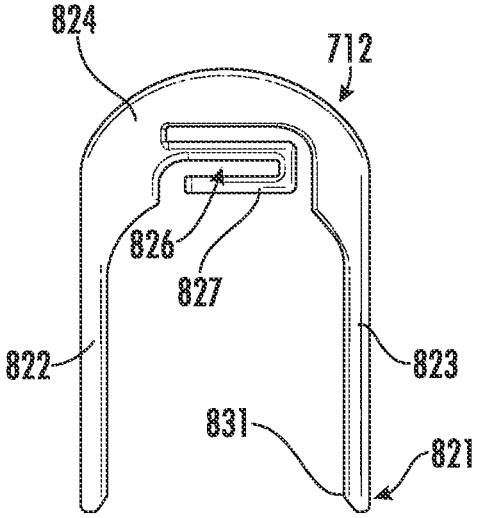
FIGS. 23A and 23B respectively show a front view and a perspective view of one embodiment of an identification element of the cable identification assembly shown in FIG. 21 respectively.
Figure 23B:
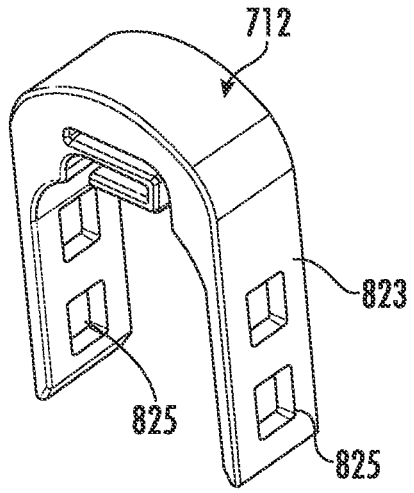
Figure 23C:
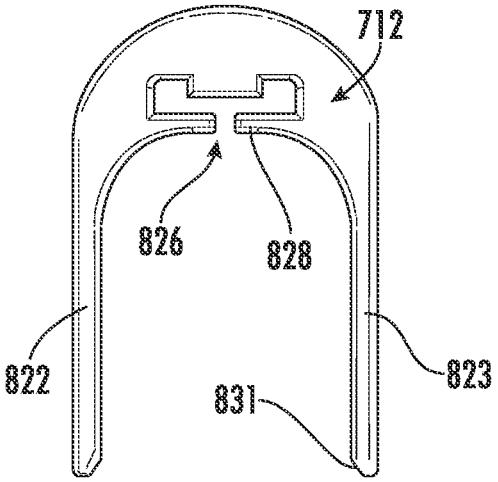
FIG. 23C shows a front view of another embodiment of an identification element of the cable identification assembly shown in FIG. 21.

Although the elastic structure 826 is disposed at the bent portion 824 of the identification element 712 in the embodiment shown in FIGS. 23A and 23C, the present disclosure is not limited to this. The elastic structure 826 may be disposed at other positions of the identification element 712, for example, at the inner surface of the two legs of the identification element 712. In one embodiment according to the present disclosure, the elastic structure 826 is disposed on the inner surface of each leg of the identification element 712 and constructed as an arched member protruding outward from the inner surface. The arched member may be elastically deformed when in contact with the cable 701, so as to produce an elastic restoring force toward the cable 701, thereby increasing a contact force or friction force between the identification element 712 and the cable 701 and thus preventing the cable identification assembly 710 from sliding on the cable 701. In addition, the arched member also enables the identification element 712 to accommodate cables 701 of different diameters. For example, the arched member may produce a smaller elastic deformation to accommodate a cable having a smaller diameter, and may produce a larger elastic deformation to accommodate a cable having a larger diameter, thereby improving the versatility of the identification element 712. In another embodiment according to the present disclosure, the identification element 712 may include a plurality of elastic structures 826 disposed at the curved portion 824 and the inner surfaces of the two legs of the identification element 712, respectively.

Figure 23D:
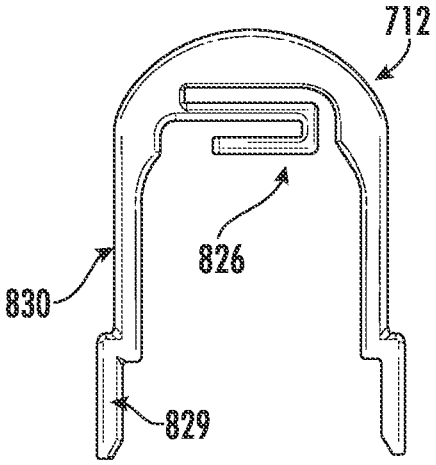
FIG. 23D shows a front view of a further embodiment of an identification element of the cable identification assembly shown in FIG. 21.
Figure 23E:
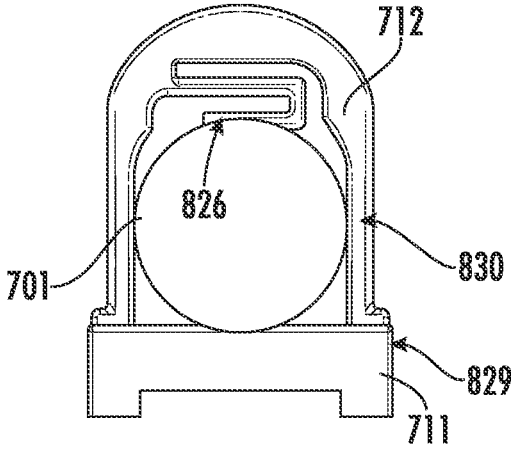
FIG. 23E shows a front view when the identification element shown in FIG. 23D is locked together with the support element.

In the embodiment shown in FIG. 23D, each identification element 712 further includes a first portion 829 that cooperates with the support element 711 and a second portion 830 that cooperates with the cable 701, wherein the first portion 829 and the second portion 830 may have different sizes. Such design eliminates the need for the size of the support element 711 to accommodate the size of the cable 701, so that the support element 711 may be manufactured as a standard member with a constant width, so as to save the manufacturing cost of the support element 711 (for example, only one set of molds for manufacturing the support element is required). Specifically, when producing the identification element 712, it is possible to allow the identification element 712 to have a first portion 829 having a constant size to cooperate with the support element 711 with a constant width. At the same time, it is possible to allow the identification element 712 to have a second portion 830 with various different sizes to cooperate with cables in different sizes (see FIG. 23E). In this way, for cables in various different sizes, there is no need to change the size of the support element 711.

In other embodiments according to the present disclosure, the inner surface of each identification element 712 may be provided with a friction portion for increasing a friction force between the identification element 712 and the cable 701. The friction portion may be disposed on the inner surfaces of the two legs of the identification element 712, for example. The friction portion may include at least one of serrations, ribs, protrusions, scores, and other configurations. When each identification element 712 is locked with the support element 711, the friction portion may prevent the identification element 712 and thus the entire cable identification assembly 10 from sliding on the cable 701. In addition, each leg of each identification element 712 may also include an inclined portion 831 located on the inner surface of the free end 821 of the leg, wherein the inclined portion helps to mount the identification element 712 to the support element 711.

Each identification element 712 according to the present disclosure may have a predetermined color, such as any one of white, red, blue, green, black, yellow orange, brown, violet, slate, or other colors. To this end, each identification element 712 may be made from a material (for example plastics such as PC material, POM material and PA material) having a predetermined color. This not only allows each identification element 712 to have a predetermined color, but also enables that each identification element 712 meets the requirements such as anti-ultraviolet, anti-aging and reuse.

The identification element 712 according to the present disclosure can be rapidly mounted and locked on the support element 711 in a single action. Specifically, when the cable identification assembly 710 is assembled, it is possible to hold the support element 711 by hand and place the cable 701 on the support element 711, and then push the identification element 712 towards the support element 711 from one side opposite to the support element 711 until the first locking member of the support element 711 is locked with the second locking member of the identification element 712 (e.g., the protrusion of the support element 711 is received into the hole of the identification element 712). Therefore, the identification element 712 according to the present disclosure can be rapidly locked on the support element 711 by a single pushing action, which can significantly improve the assembly efficiency of the cable identification assembly 710 of the present disclosure. In addition, if the identification element 712 and the support element 711 need to be unlocked, the portion of the free end 821 of the identification element 712 that projects from the back surface of the support element 711 may be pulled outward along the width direction W of the support element 711, so that the protrusion of 711 is removed from the hole of the identification element 712, whereby the identification element 712 can be easily and rapidly removed from the support element 711. By such simple and rapid locking and unlocking between the identification element 712 and the support element 711, the cable identification assembly 710 according to the present disclosure is easily assembled and disassembled, which can greatly save the assembly and disassembly time of workers and reduce the labor cost as well as the chance of making mistakes. In addition, since the identification element 712 and the support element 711 may be unlocked simply and rapidly, the cable identification assembly 710 according to the present disclosure also allows one or more of the plurality of identification elements 712 to be rapidly removed from the cable identification assembly 710 that has been assembled, and identification elements 712 with other predetermined colors that have been re-selected to be rapidly assembled. Therefore, the cable identification assembly 710 according to the present disclosure can also allow a rapid adjustment of the color code, which is particularly advantageous in the case where it is necessary to adjust the color code of the cable identification assembly 710 (for example, some cables are required to have different color codes in a test phase and a normal operation phase of the base station antenna). Further, the cable identification assembly 710 according to the present disclosure may meet the requirements such as anti-ultraviolet, anti-aging and reuse, which is favorable for the environment and can save the cost.

Figure 24:
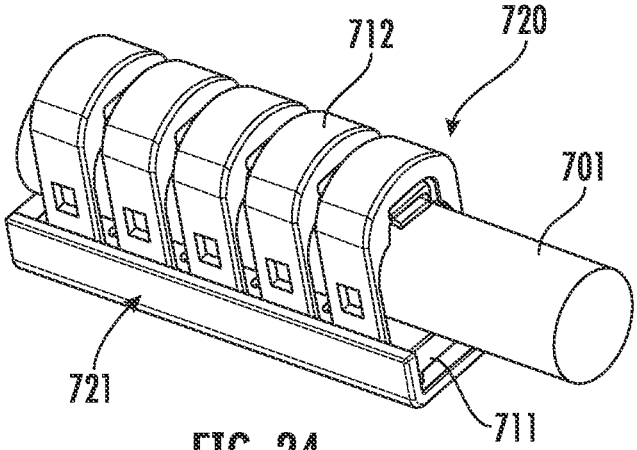
FIG. 24 shows a perspective view of a color-coded cable identification assembly according to another embodiment of the present disclosure.
Figure 25A:
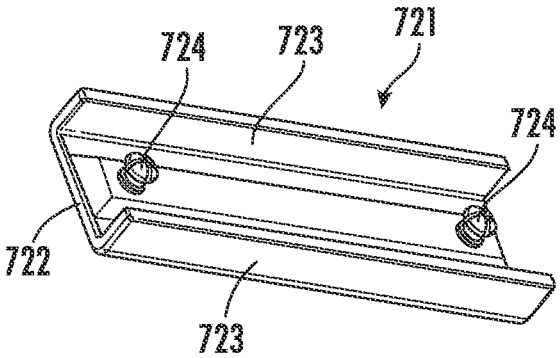
FIG. 25A shows a perspective view of one embodiment of a cover of the cable identification assembly shown in FIG. 24.
Figure 25B:
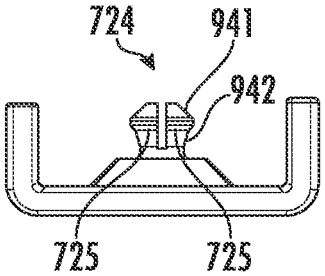
FIG. 25B shows a front view of a fixing element disposed on the cover shown in FIG. 25A.

FIG. 24 shows a perspective view of a color-coded cable identification assembly 720 according to another embodiment of the present disclosure. Compared with the cable identification assembly 710 shown in FIG. 1, the cable identification assembly 720 shown in FIG. 4 further includes an anti-unlocking element 721 for preventing the identification element 712 from being unlocked from the support element 711. Referring to FIGS. 25A, 25B and the anti-unlocking element 721 may be constructed as a cover, which may include a bottom 722 and side walls 723 projecting upward from both sides of the bottom 722. The side walls are configured to prevent the second locking member 825 of the identification element 712 from moving towards a direction that will unlock the second locking member from the first locking member 810 of the support element 711. Specifically, when the assembly of the cable identification assembly 720 is accomplished, the side wall 723 of the cover can cover the free end 821 of the identification element 712, thereby avoiding that the identification element 712 and the support element 711 are accidentally unlocked due to the cable 701 swinging along the width direction W of the support element 711, for example.

Figure 26A:
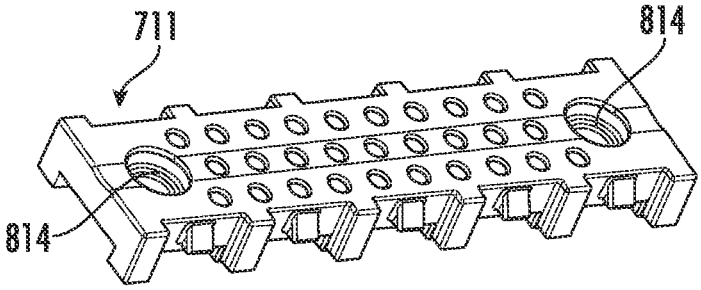
Figure 26B:
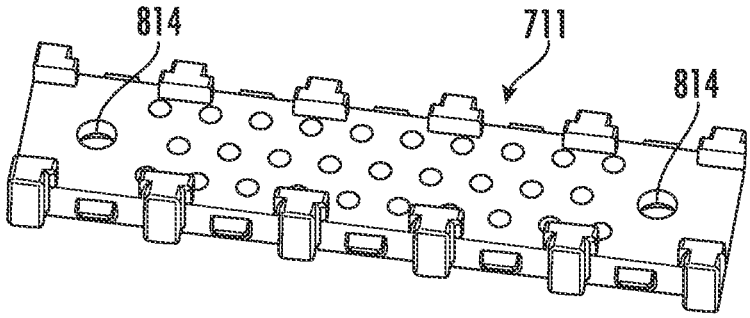
Figure 27:
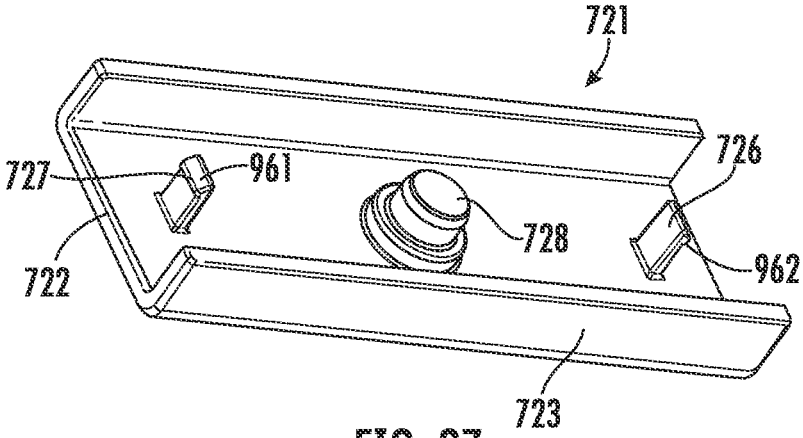
FIG. 27 shows a perspective view of another embodiment of a cover of the cable identification assembly shown in FIG. 24.

The cover can be fixed on the support element 711 by a fixing element. In an embodiment according to the present disclosure, a fixing element may be provided at the bottom 722 of the cover, as shown in FIGS. 25A, 25B, and 27. The fixing element may be constructed as a snap-fit element capable of forming an interference fit with an aperture provided in the support element 711, so as to fix the cover to the support element 711. In the embodiment shown in FIGS. 25A and 25B, the snap-fit element 724 is configured to include a plurality of expanded portions 725, which can be in an interference fit with a circular aperture 814 of the support element 711 shown in FIGS. 26A and 26B, so as to implement the fixing of the cover with the support element 711. Specifically, when the cover is fixed to the support element 711, first, the snap-fit element 724 is inserted into the circular aperture 814 from one side. During this insertion process, the plurality of portions 725 may be gathered together to facilitate the inserting of the snap-fit element 724. Then, when the snap-fit element 724 has been inserted and projected to the other side of the circular aperture 814, the plurality of portions 725 may be expanded again to lock the snap-fit element 724 in the circular aperture 814, thereby fixing the cover to the support element 711. In order to facilitate the insertion of the snap-fit element 724 into the circular aperture 814, the snap-fit element 724 (specifically, each portion 725 of the snap-fit element 724) may include an upper inclined portion 941, which is configured to guide the snap-fit element 724 to the circular aperture 814 and cause the plurality of portions 725 of the snap-fit element 724 to gather together. In addition, in order to facilitate the extraction of the snap-fit element 724 from the circular aperture 814 so as to remove the cover from the support element 711 during the process of removing the cable identification assembly 720, the snap-fit element 724 (specifically, each portion 725 of the snap-fit element 724) may further include a lower inclined portion 942, which causes the plurality of portions 25 of the snap-fit element 724 to gather together when the operator extracts the snap-fit element 724, so that it is possible to extract the snap-fit element 724 from the circular aperture 814.

Figure 28A:
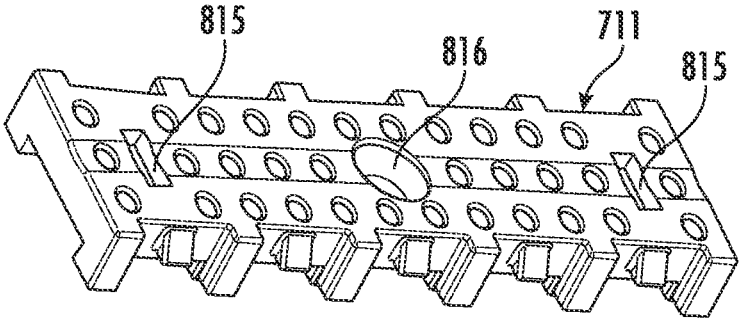
Figure 28B:
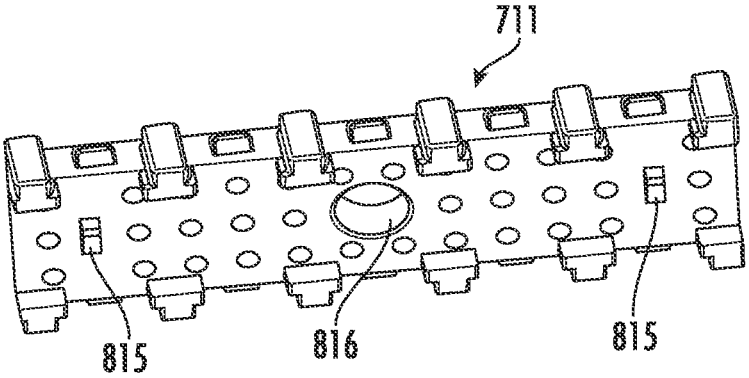
Figure 29:
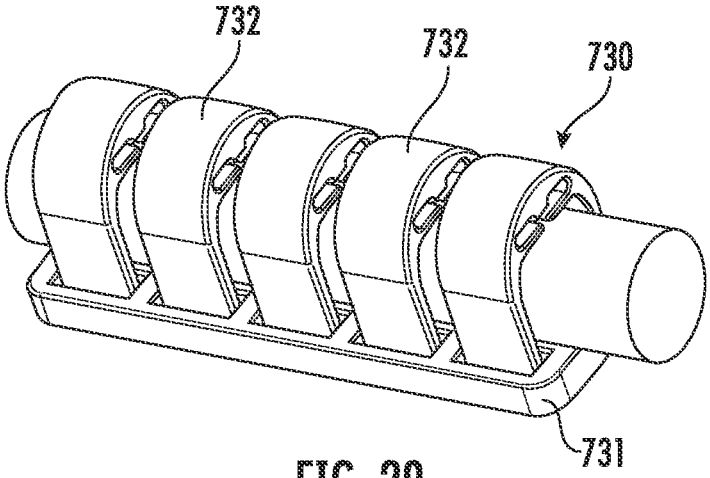
FIG. 29 shows a perspective view of a color-coded cable identification assembly according to a further embodiment of the present disclosure.

In the embodiment shown in FIG. 27 the snap-fit element 726 is constructed as a plate-shaped member having a protrusion 727. The snap-fit element 726 can implement the fixing of the cover with the support element 711 by means of an interference fit of its protrusion 727 with a square aperture 815 of the support element 711 as shown in FIGS. 28A and 28B. Specifically, when the cover is fixed to the support element 711, first, the snap-fit element 726 is inserted into the square aperture 815 from one side. During this insertion process, the protrusion 727 of the locking element 726 elastically flexes the locking element 726 so that the protrusion 727 can be inserted through the square aperture 815. Then, when the protrusion 727 has been inserted and projected to the other side of the square aperture 815, the snap-fit element 726 may be restored to its initial position, so that the protrusion 727 forms an interference fit with the square aperture 815, thereby fixing the cover to the support element 711. Similarly, in order to facilitate the insertion of the snap-fit element 726 into the square aperture 815, the snap-fit element 726 (specifically, the protrusion 727 of the snap-fit element 726) may include an upper inclined portion 961, which is configured to guide the snap-fit element 726 to the square aperture 815 and cause the snap-fit element 726 to flex elastically so as to insert the protrusion 727 into the square aperture 815. In addition, in order to facilitate the extraction of the snap-fit element 726 from the square aperture 815 so as to remove the cover from the support element 11 during the process of removing the cable identification assembly 720, the snap-fit element 726 (specifically, the protrusion 727 of the snap-fit element 726) may further include a lower inclined portion 962, which causes the snap-fit element 726 to flex elastically to allow the protrusion 727 to enter the square aperture 815, so that it is possible to extract the snap-fit element 726 from the square aperture 815.

In the embodiment shown in FIG. 27, the bottom of the cover may also be provided with a positioning element 728 for positioning the cover relative to the support element 711, so that the snap-fit elements 724 and 726 disposed on the bottom of the cover is easily inserted into the circular aperture 814 and the square aperture 815 on the support element 711. The positioning element 728 may be constructed as a guide post, and correspondingly, the support plate 711 may be provided with a hole 816 for receiving the guide post, as shown in FIGS. 28A and 28B.

In other embodiments according to the present disclosure, the fixing element may have other configurations. For example, the fixing element may be an independent element separate from the cover, such as a screw or the like.

In other embodiments according to the present disclosure, the anti-unlocking element 721 may have other configurations. For example, the anti-unlocking element 721 may be constructed as a rectangular frame that can be sleeved at the outer periphery of the support element 711. In this configuration, the anti-unlocking element 721 may be fixed to the support element 711 by a close fit with the outer periphery of the support element 711 without using a fixing element.

Figure 30:
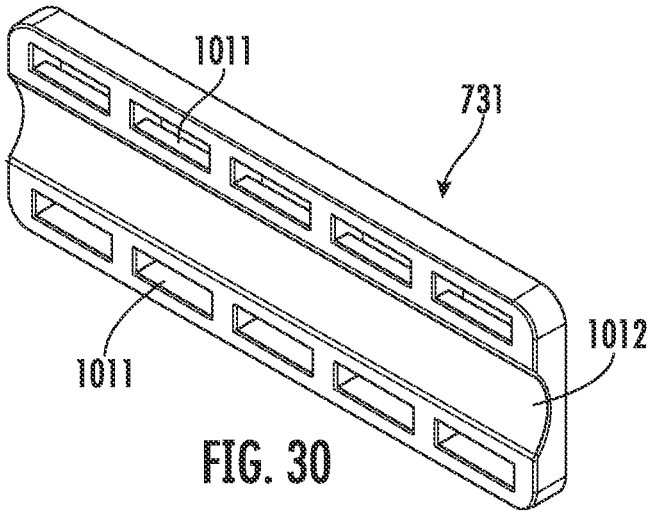
FIG. 30 shows a perspective view of a support element of the cable identification assembly shown in FIG. 29.
Figure 31:
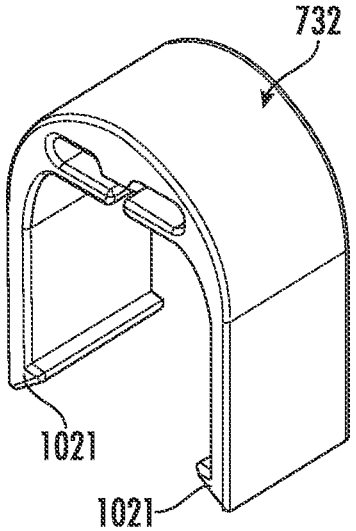
FIG. 31 shows a perspective view of an identification element of the cable identification assembly shown in FIG. 29.
Figure 32:
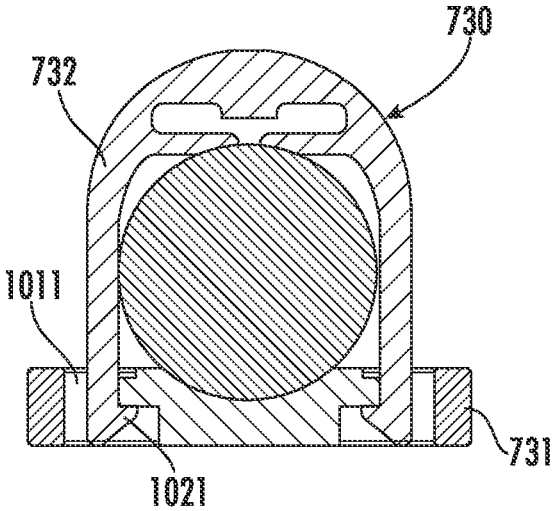
FIG. 32 shows a cross-sectional view of the cable identification assembly shown in FIG. 29.

Referring to FIGS. 29 to 32, a color-coded cable identification assembly 30 according to a further embodiment of the present disclosure is shown. The cable identification assembly 730 includes a support element 731 and a plurality of identification elements 732. The support element 731 may have a plate shape, and the identification element 732 may have a U shape. The support element 731 includes a plurality of pairs of first locking members 1011, and each identification element 732 includes a pair of second locking members 1021. The pair of second locking members 1021 are adapted to be locked with a corresponding pair of first locking members 731 of the support element 731. As shown in FIGS. 30 and 31, in this embodiment, each pair of first locking members 1011 of the support element 731 are configured to be a pair of openings located at the front surface of the support element 731 and penetrating through the support element 731. Moreover, the pair of second locking members 1021 of each identification element 732 is constructed as a pair of barbs located on two legs of each identification element 732. The two legs of each identification element 732 can be rapidly inserted into the openings of the support element 731 by means of a single action and locked on the support element 731 by means of an interference fit of the barbs with the openings (as shown in FIG. 32). In addition, the support element 731 further includes a recess 1012 disposed on the front surface thereof. The recess 1012 is configured to receive the cable to facilitate the assembly of the cable identification assembly 730. The support element 731 and the identification element 732 may be made by the same material and method as the support element 711 and the identification element 712, and thus will not be described in detail here.

Although each cable identification assembly 710, 720, and 730 includes five identification elements in the illustrated embodiments, the present disclosure is not limited to this. The cable identification assemblies 710, 720 and 730 may include any other number of identification elements (e.g. two, three, four, six, seven, eight, etc.), thereby forming various different color codes to identify the cable.

Exemplary embodiments according to the present disclosure have been described in detail above with reference to the accompanying drawings. However, those skilled in the art should appreciate that a plurality of changes and modifications may be made to the exemplary embodiments of the present disclosure without departing from the spirit and scope of the present disclosure. All the changes and modifications are encompassed within the protection scope of the present disclosure as defined by the claims. The present disclosure is defined by the appended claims, and the equivalents of these claims are also contained therein.

What is claimed is:

1. A color-coded cable identification assembly, characterized in that the cable identification assembly comprises:

a support element; and a plurality of identification elements, wherein each of the plurality of identification elements is lockable with the support element to form the cable identification assembly, and the plurality of identification elements fixedly mount the cable identification assembly to a cable by locking the cable between the support element and the plurality of identification elements;

wherein each identification element has a predetermined color so that the plurality of identification elements are capable of forming a predetermined color code to identify the cable.

2. The color-coded cable identification assembly according to claim 1, characterized in that the support element includes a plurality of pairs of first locking members, and each identification element includes a pair of second locking members, wherein the pair of second locking members of each identification element are adapted to be locked with one pair of the plurality of pairs of first locking members of the support element.

3. The color-coded cable identification assembly according to claim 1, characterized in that an inner surface of each identification element is provided with an elastic structure which abut against the cable with an elastic force when the identification element is locked with the support element.

4. The color-coded cable identification assembly according to claim 1, characterized in that an inner surface of each identification element is provided with a friction portion for increasing a friction force between the identification element and the cable.

5. The color-coded cable identification assembly according to claim 1, characterized in that each identification element further includes a first portion that cooperates with the support element and a second portion that cooperates with the cable, wherein the first portion and the second portion have different sizes.

6. The color-coded cable identification assembly according to claim 1, characterized in that each identification element is configured to be locked on the support element with a single action.

7. The color-coded cable identification assembly according to claim 1, characterized in that the support element has a plate shape.

8. The color-coded cable identification assembly according to claim 1, characterized in that the cable identification assembly further includes an anti-unlocking element for preventing the identification element from being unlocked from the support element.

9. The color-coded cable identification assembly according to claim 1, characterized in that the support element is a support element made from plastic.

10. The color-coded cable identification assembly according to claim 1, characterized in that each identification element is an identification element made from a material having a predetermined color.

11. A color-coded cable identification assembly, comprising:

a support element; and a plurality of identification elements aligned with each other and mounted to the support element via locking features, wherein the plurality of identification elements and the support element define a cavity for a cable;

wherein each identification element has a predetermined color so that the plurality of identification elements display a predetermined color code to identify the cable.

12. The color-coded cable identification assembly according to claim 11, wherein an inner surface of each identification element is provided with an elastic structure which abut against the cable with an elastic force when the identification element is locked with the support element.

13. The color-coded cable identification assembly according to claim 11, wherein an inner surface of each identification element is provided with a friction portion for increasing a friction force between the identification element and the cable.

14. The color-coded cable identification assembly according to claim 11, wherein each identification element is configured to be locked on the support element with a single action.

* * * * *